US010844703B2

(12) United States Patent
Jones et al.

(10) Patent No.: US 10,844,703 B2
(45) Date of Patent: Nov. 24, 2020

(54) SYSTEM AND METHOD FOR DOWNLINK COMMUNICATION

(71) Applicant: SANVEAN TECHNOLOGIES LLC, Katy, TX (US)

(72) Inventors: Stephen Jones, Cypress, TX (US); Junichi Sugiura, Bristol (GB)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 0 days.

(21) Appl. No.: 15/441,087

(22) Filed: Feb. 23, 2017

(65) Prior Publication Data

US 2017/0254190 A1 Sep. 7, 2017

Related U.S. Application Data

(60) Provisional application No. 62/303,931, filed on Mar. 4, 2016.

(51) Int. Cl.

| | |
|---|---|
| ***E21B 44/00*** | (2006.01) |
| ***E21B 3/025*** | (2006.01) |
| ***E21B 4/20*** | (2006.01) |
| ***E21B 7/04*** | (2006.01) |
| ***E21B 47/00*** | (2012.01) |
| ***E21B 47/12*** | (2012.01) |

(52) U.S. Cl.

CPC ..... *E21B 44/005* (2013.01); *E21B 3/025* (2013.01); *E21B 4/20* (2013.01); *E21B 7/04* (2013.01); *E21B 47/00* (2013.01); *E21B 47/12* (2013.01)

(58) Field of Classification Search

USPC ..... 340/853.3

See application file for complete search history.

(56) References Cited

U.S. PATENT DOCUMENTS

| | | | | |
|---|---|---|---|---|
| 3,697,952 | A * | 10/1972 | Hayre | E21B 43/017 340/853.1 |
| 7,245,229 | B2 * | 7/2007 | Baron | G01V 11/002 340/853.3 |
| 2005/0001737 | A1 * | 1/2005 | Baron | G01V 11/002 340/854.4 |
| 2007/0289373 | A1 | 12/2007 | Sugiura | |

(Continued)

OTHER PUBLICATIONS

International Search Report and Written Opinion issued in Application No. PCT/US17/19188, dated Jun. 12, 2017, 10 pages.

*Primary Examiner* — Ojiako K Nwugo
(74) *Attorney, Agent, or Firm* — Adolph Locklar

(57) ABSTRACT

A method may include communicating a command into a wellbore from the surface. The method may include determining a command to be sent to a downhole tool, and translating the command into a message, the message including a sequence of codes. The method may include rotating the drill string substantially at the set point RPM for a predetermined duration and measuring the rotation rate of the drill string. The method may include identifying the received set point RPM and rotating the drill string consistent with a first code value of a first code of the message as encoded. The method may also include decoding the first code and rotating the drill string consistent with a second code value of a second code of the message as encoded. The method may also include decoding the second code, identifying the command from at least one of the decoded first and second code and executing the command.

36 Claims, 15 Drawing Sheets

(56) References Cited

U.S. PATENT DOCUMENTS

| | | | | |
|---|---|---|---|---|
| 2014/0239959 | A1* | 8/2014 | Clarkson | E21B 47/13 324/338 |
| 2015/0107903 | A1* | 4/2015 | Sugiura | E21B 44/005 175/45 |
| 2015/0226050 | A1 | 8/2015 | Bartel et al. | |
| 2016/0145999 | A1* | 5/2016 | Clarkson | E21B 47/13 340/854.6 |
| 2016/0252454 | A1* | 9/2016 | Zuo | G01N 11/00 250/254 |
| 2017/0234125 | A1* | 8/2017 | Zhang | E21B 47/06 175/40 |
| 2017/0350243 | A1* | 12/2017 | Pillai | E21B 47/182 |
| 2018/0298749 | A1* | 10/2018 | Barak | E21B 47/18 |

* cited by examiner

SYSTEM AND METHOD FOR DOWNLINK COMMUNICATION

CROSS REFERENCE TO RELATED APPLICATIONS

This application is a non-provisional application which claims priority from U.S. provisional application No. 62/303,931, filed Mar. 4, 2016, which is incorporated by reference herein in its entirety.

TECHNICAL FIELD/FIELD OF THE DISCLOSURE

The present disclosure relates generally to systems and methods for communicating information from the surface to equipment located in a borehole, and specifically to use of variations in drill string rotation rates for communication.

BACKGROUND OF THE DISCLOSURE

When drilling a wellbore, communication of information between the surface and devices located within the wellbore may be desirable. Information that may be communicated between the surface and devices located within the wellbore may include data and commands for downhole equipment, including, but not limited to downhole steering tool, downhole vibratory tool, MWD (measurement-while-drilling) tool, and LWD (logging-while-drilling) tool. In certain instances, communication between the surface and devices located within the wellbore may be accomplished by altering drilling operations, such as modifying the flow of fluids through the drillstring, the amount of weight which is placed on the bit, or the revolutions of the drillstring. By altering these aspects of the drilling operations, coded sequences may be sent from the surface to the downhole equipment, where sensors may detect the coded sequences.

Downhole steering tools are often classified as either "point-the-bit" or "push-the-bit" systems. In point-the-bit systems, the rotational axis of the drill bit is deviated from the longitudinal axis of the drill string generally in the direction of the wellbore. The wellbore may typically be propagated in accordance with a three-point geometry defined by upper and lower stabilizer touch points and the drill bit. The angle of deviation of the drill bit axis, coupled with a finite distance between the drill bit and the lower stabilizer, results in a non-collinear condition that generates a curved wellbore.

In push-the-bit systems, the non-collinear condition may be achieved by causing one or both of upper and lower stabilizers, for example via blades or pistons, to apply an eccentric force or displacement to the BHA to move the drill bit in the desired path. Steering may be achieved by creating a non-collinear condition between the drill bit and at least two other touch points, such as upper and lower stabilizers, for example.

SUMMARY

The present disclosure includes a method for communicating a command into a wellbore from the surface. The method includes providing a downhole tool. The downhole tool is coupled to a drill string, where the drill string is rotated by a top drive at the surface. The downhole tool includes a downhole decoder and a drill string rotation rate sensor, and the top drive is controlled by a rotation controller. The method also includes determining a command to be sent to the downhole tool, and translating the command into a message, the message including a sequence of codes. In addition, the method includes selecting a set point RPM, and encoding the message based on a predetermined encoding scheme. Each code of the sequence of codes of the message is encoded onto an RPM value, the RPM value offset from the set point RPM, or duration of a drill string rotation step. The method includes rotating the drill string substantially at the set point RPM for a predetermined duration and measuring the rotation rate of the drill string. The method also includes determining by the downhole decoder that the rotation rate of the drill string remains generally constant for the predetermined duration to determine if a set point RPM has been received, and identifying the received set point RPM with the downhole decoder. In addition, the method includes rotating the drill string consistent with a first code value of a first code of the message. The method also includes decoding the first code and rotating the drill string consistent with a second code value of a second code of the message as encoded. Further, the method includes determining that the second code has been received by the downhole decoder, and decoding the second code. In addition, the method includes identifying the command from at least one of the decoded first and second code and executing the command.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
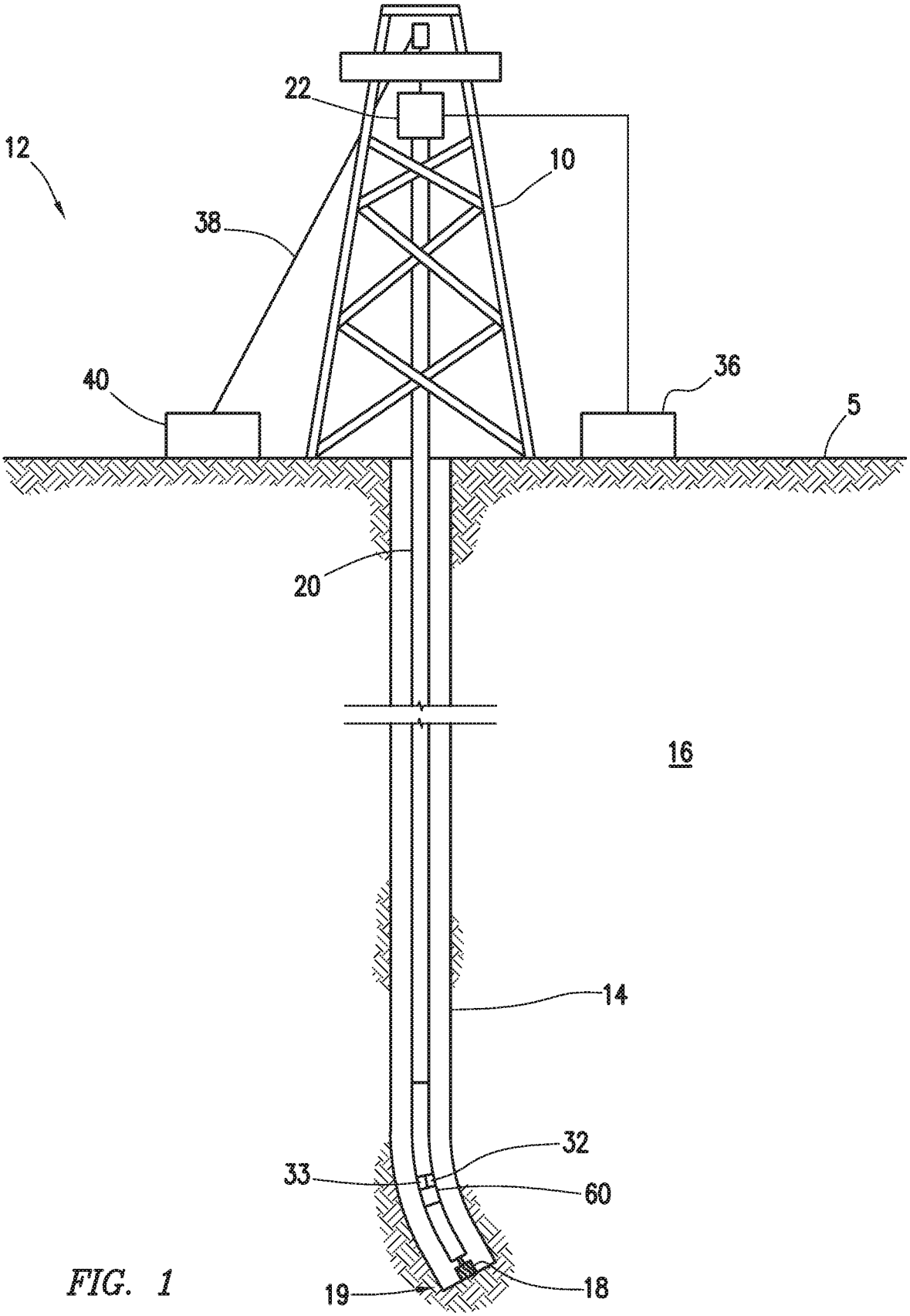
FIG. 1 depicts a schematic view drilling system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling system 12, which includes derrick 10 positioned at the surface 5. Top drive 22 is suspended from derrick 10 and is connected to drawworks 40 by line 38. Top drive 22, in conjunction with drawworks 40 and line 38, may raise and lower drill string 20 into wellbore 14 as wellbore 14 is formed in formation 16. Wellbore 14 may be drilled with drill bit 18 positioned at a bottom end 19 of drill string 20. In certain embodiments, drill string 20 may be rotated by top drive 22, although one having ordinary skill in the art with the benefit of this disclosure will understand that a rotary table may be utilized to rotate drill string 20 as described herein without deviating from the scope of this disclosure.

In some embodiments, the rotation of drill string 20 by top drive 22 may be controlled by rotation controller 36. Rotation controller 36 may be manually or automatically controlled. Rotation controller 36 may, for example and without limitation, control the rate of rotation of drill string 20 in response to a command as discussed herein below. Downhole tool 60, positioned on drill string 20, may include a rotation rate sensor positioned to measure the rotation rate of drill string 20.

In some embodiments, rotation controller 36 may control the rotation of drill string 20 in order to communicate a command or data to downhole tool 60 positioned on drill string 20. Downhole tool 60 may be configured to receive and interpret the command or data as discussed further herein below. Downhole tool 60 may be any downhole tool to which a command or data may be sent and may include, for example and without limitation, a directional drilling tool, a rotary steerable system (RSS), a rotary steerable motor, a turbine assisted RSS, a gear-reduced turbine assisted RSS, a steerable coiled tubing tool, a steerable motor, a steerable turbine, a vibratory tool, an oscillation tool, a friction reduction tool, a shock tool, a vibration/shock damper tool, a jarring tool, a reamer, or an independent sub. For the purposes of this disclosure, messages, data, and commands are discussed with respect to a directional drilling tool, but one having ordinary skill in the art with the benefit of this disclosure will understand that downhole tool 60 may be any downhole tool and may receive any commands or data associated therewith in accordance with embodiments of the present disclosure.

In some embodiments, downhole tool 60 may include a controller having a programmable processor such as a microprocessor or a microcontroller and processor-readable or computer-readable programming code embodying logic embedded on tangible, non-transitory computer readable media, including instructions for controlling the function of downhole tool 60. In some embodiments, the controller may receive a command encoded onto rotation rate of drill string 20 from surface 5 as further discussed herein below. The controller may receive the command and may interpret the command to cause downhole tool to execute the command. The controller may also optionally communicate with other instruments in the drill string, such as telemetry systems that communicate with surface 5. It will be appreciated that the controller is not necessarily located in a directional drilling tool, and may be disposed elsewhere in drill string 20 in electronic communication with the directional drilling tool. Moreover, one skilled in the art with the benefit of this disclosure will understand that the multiple functions performed by the controller may be distributed among a number of devices.

Figure 2:
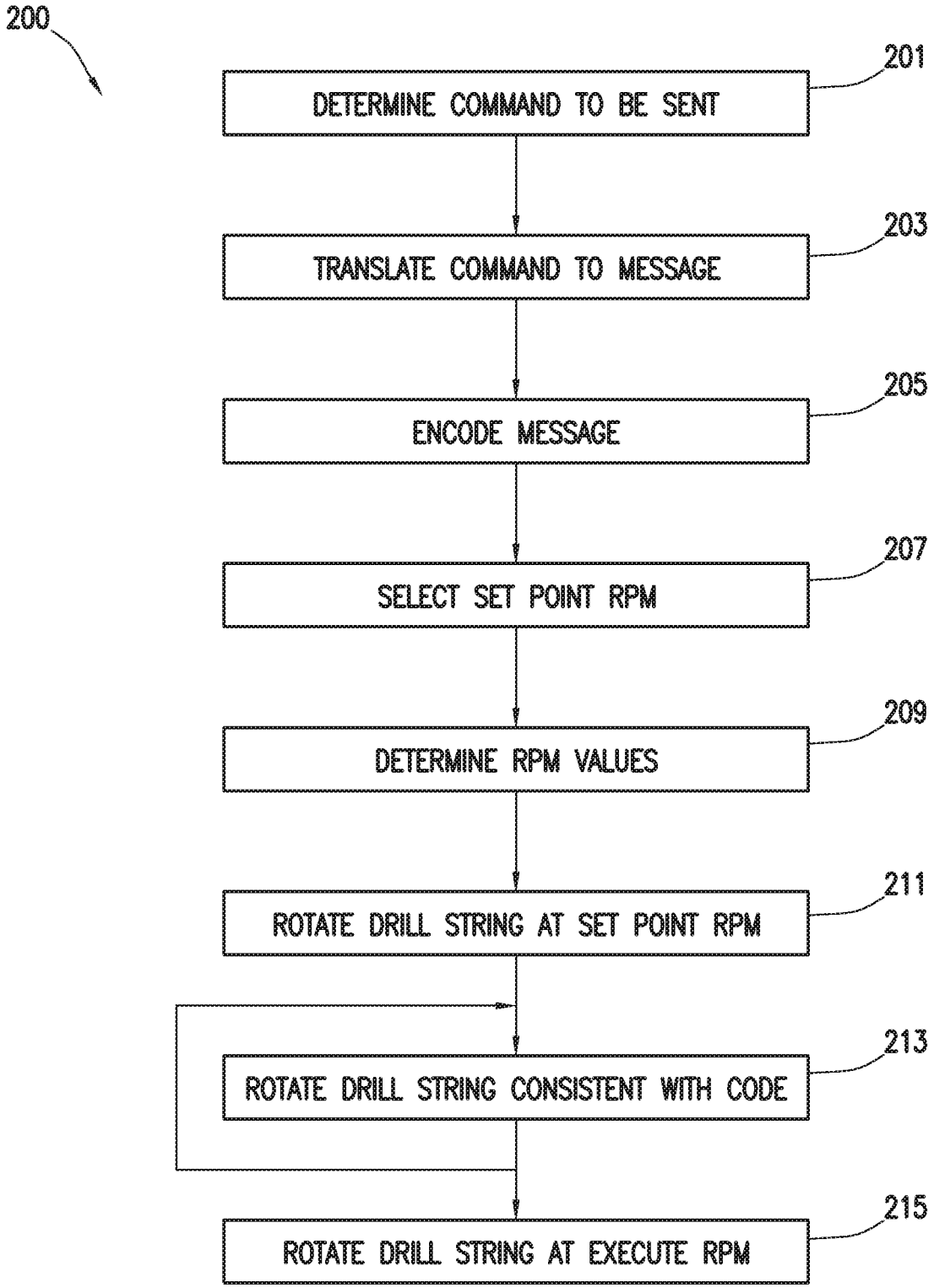
FIG. 2 depicts a flow chart of a command communication operation consistent with at least one embodiment of the present disclosure.

As an example, FIG. 2 depicts a flow chart of a command communication operation 200 consistent with at least one embodiment of the present disclosure in which a command is sent from the surface 5 to downhole tool 60. In some embodiments, command communication operation 200 may include determining a command to be sent to downhole tool 60 (201).

The command may be an input or any other signal to be sent to downhole tool 60. In some embodiments, the command may be selected from a preselected set of command types based on the type of downhole tool 60. In some embodiments, the command may be to modify a downhole tool parameter, such as a change in the operational state of downhole tool 60, a modification to a previous command, a wake-up signal, a sleep (power-save) signal, a blade-collapse signal, an all-blade-extend signal, a tool activation signal, a tool deactivation signal, a desired hydraulic valve position, a trigger, a modification to a parameter of downhole tool 60, or any other desired input to the operation of downhole tool 60. For example, during a drilling operation, it may be desired to send a command to downhole tool 60 to change the downhole tool parameter. The command may include a type of command, an indication of the parameter to be changed, and a value representing the change in parameter or a desired operating mode.

In some embodiments, the command or data may be translated into a message (203). In some embodiments, the message may be generated from the command or data based on a predetermined syntax. The predetermined syntax may be selected based on what downhole tool 60 is utilized and the available commands to be sent thereto. In some embodiments, the message may be a sequence of codes into which the command is parsed based on the predetermined syntax. In some embodiments, the code values of one or more codes of the message may identify the type of command, and other code values may contain the content or data of the command. The predetermined syntax may determine the meaning of each code of the message based on the type of command or data. The content of the command may include, for example and without limitation, a value for a parameter of downhole tool 60 or a selected operating mode.

For example and without limitation, an example command communication operation 200 is described with respect to an embodiment in which downhole tool 60 is an RSS. One having ordinary skill in the art with the benefit of this disclosure will readily understand that the described is intended merely to clarify and elucidate the present disclosure and is not intended to limit the scope of the disclosure.

In some such embodiments, for example and without limitation, the available commands to be sent may include modifications to toolface, offset, or operating mode of downhole tool 60.

As used herein and understood in the art, "toolface" refers to the direction in which wellbore 14 is being drilled. In some embodiments, toolface may refer to the angular direction that drill bit 18 is pushing or pointing with respect to the Earth's gravity field. In some embodiments, as used herein, toolface may be an angular measurement relative to the Earth's gravity field at drill bit 18, such that "toolface=0 degree" indicates a direction opposite the gravity field. If the tool's demand toolface is set to 0 degrees, the tool is expected to perform pure build, i.e. progress drilling of wellbore 14 in a direction opposite that of the gravity field. Similarly, "toolface=90 degrees," "toolface=270 degrees," and "toolface=180 degrees" correspond to pure right turn, pure left turn, and pure drop, respectively.

As used herein and understood in the art, "offset" refers to the magnitude (typically indicated in inches) of the change in direction of drilling of wellbore 14, also referred to as curvature, build rate, or dogleg severity. In some embodiments, the offset may be defined by an eccentricity of the axis of downhole tool 60 from the axis of wellbore 14. Such eccentricity tends to alter an angle of approach of drill bit 18 and thereby change the direction in which wellbore 14 is drilled. Although described with respect to offset, one having ordinary skill in the art with the benefit of this disclosure will understand that the parameter referred to herein as offset is equally applicable to steerable systems which define the magnitude of the change in direction of drilling of wellbore 14 as "steering ratio (proportion)". As understood in the art, the steering ratio (SR) corresponds to how steep the curve is measured relative to the maximum curvature able to be imparted by the steerable system. For example, SR=0%, 50%, and 100% correspond to neutral drilling (no curvature), 50% of the maximum curvature (or maximum dogleg), and the maximum curvature (maximum dogleg), respectively.

In some embodiments, the toolface and offset may be controllable by, for example and without limitation, controlling the relative radial positions of steering tool blades positioned on downhole tool 60. In general, increasing the offset tends to increase the curvature of wellbore 14 upon subsequent drilling. In some embodiments, by controlling the toolface and the offset, a directional drilling system (e.g., a rotary steerable system, coiled-tubing system, rotary-steerable motor system, etc) may control the propagation of wellbore 14 in two or three dimensions.

Although described with respect to toolface and offset, one having ordinary skill in the art with the benefit of this disclosure will understand that these tool parameters may be referred to with different terminology depending on the type of steerable system. For example, toolface and offset may be referred to or defined in terms of, for example and without limitation, force vector toolface, pressure vector toolface, position vector toolface, force vector magnitude, pressure vector magnitude, position offset magnitude, eccentric distance, and steering ratio. One having ordinary skill in the art with the benefit of this disclosure will understand that the terms toolface and offset do not limit the scope of this disclosure to any particular measure or definition of drilling direction and curvature magnitude.

In some embodiments, such as, for example and without limitation, in a "push-the-bit" configuration, the direction (tool face) of subsequent drilling may be substantially the same as the direction of the offset between the tool axis and the axis of wellbore 14. For example and without limitation, in a push-the-bit configuration, commanding downhole tool 60 to have a toolface of 90 degrees (relative to high side) may indicate an input to steer the progression of wellbore 14 to the right as the drilling operation progresses. In some embodiments, in which a "point-the-bit" steering tool is utilized, the direction of subsequent drilling progresses in the opposite direction as the tool face (i.e., to the left in the above example). One having ordinary skill in the art with the benefit of this disclosure will understand that the present disclosure is not limited to the above described steering tool embodiments.

In some embodiments, the message may include a first code representative of whether the command is related to modifying the toolface or modifying the offset. The message may include a second code which represents an operating mode or a syntax for the following codes. For example and without limitation, the first code may be selected from "modify toolface" or "modify offset". In some embodiments, a second code may be selected from "hold mode", in which the tool is instructed to hold the current inclination and/or azimuth, or to indicate that a value representing a desired modification in toolface or offset is being sent. In some embodiments, set points for a closed-loop steering algorithm, such as for target inclination, azimuth, and/or dogleg, among others, may be included in the command. In some embodiments, the command may correspond to a desired relative change to a current set point, such as, for example and without limitation, a relative change to a current target inclination or azimuth. In some embodiments, the command may include a desired rate of penetration (ROP), surface-measured drilling speed, drill bit rate of rotation, and/or drill bit/tool depth.

In some embodiments, a hold mode command may instruct downhole tool 60 to continuously adjust the downhole tool parameters to maintain a selected target inclination, azimuth, or dogleg as the drilling operation progresses, referred to herein as "hold mode." In some embodiments, the inclination, azimuth, or dogleg may be measured by downhole tool 60, and may be continuously compared against the target inclination, azimuth or dogleg, and, depending on the error or difference between the target and actual values, the programmed toolface and/or offset may be adjusted accordingly, such as to minimize the error or difference in the next iteration.

In certain embodiments, a controller may be used in the hold mode to adjust the speed at which adjustments are made in the adjustments of downhole tool parameters, i.e., gain. In such embodiments, gain may be modified using a command. For example, when surface-measured drilling speed is communicated to the controller through rate of rotation, the gain of the controller may be adjusted. For example, when the drilling speed is low, the gain of the controller is low. When the drilling speed is high, the gain of the controller is high. Gain may include proportional gain, proportional and integral gain, or proportion, integral, and derivative gain. The gain may be controlled by a proportional controller (P), proportional-integral (PI) controller, proportional-integral-differential (PID) controller, predictive controller, or other controllers used for gain control and, may be modified, depending on the communicated surface-measured drilling speed.

In some embodiments, a command may be used to instruct a downhole telemetry unit to enter an uplink-telemetry mode, i.e., to communicate information to the surface. A non-limiting example of a downhole telemetry unit is a mud pulse telemetry unit. The command may instruct the downhole telemetry unit to communicate information provided to the downhole telemetry unit by sensors or other downhole equipment, including but not limited to diagnostic parameters, confirmation signal to surface (such as that the command was received), or tool diagnostics for troubleshooting a downhole tool.

In some embodiments, a second code may indicate the type of value being sent. For example and without limitation, in some embodiments, the second code may indicate if a coarse value, a fine value, or a coarse and fine value are being sent in the command.

In some embodiments, multiple codes may be utilized to specify the value of the desired modification. In some embodiments, for example, a coarse value may be selected from a predetermined list of values. For example, for a modify toolface command, the coarse value may be selected from 0°, 90° Left, 90° Right, and 180 degrees. In some embodiments, the coarse value may be an absolute value measured relative to an outside reference point and not based upon a current parameter. In some embodiments, a fine value may be selected from a predetermined list of values which indicate a modification relative to the current toolface or offset or an offset to the coarse value. In some embodiments, the second code may indicate what types of values are to be sent, indicating that a coarse value only, a fine value only, or a course value and a fine value are included with the message. As an example, where it is desired to send a command to "Change the toolface of the RSS to 75° left," the message may be "Modify toolface, coarse and fine values are being sent, 90° Left, −15°."

Once the message is generated (203), the message may be encoded into a series of drill string rotation steps (205) according to a predetermined encoding scheme. In some embodiments, the predetermined encoding scheme may, for example and without limitation, provide a framework for encoding code values of the message into the drill string rotation steps. In each drill string rotation step, rotation controller 36 may rotate drill string 20 at a rotation rate (referred to herein as "RPM" of the drill string rotation step) for a time period (referred to herein as a "duration" of the drill string rotation step). During each drill string rotation step, a code value may be encoded onto the RPM of drill string 20 during the drill string rotation step (referred to herein as an "RPM value") or onto the duration of the drill string rotation step. In some embodiments, as used herein, encoded onto means that an RPM value or duration of a drill string rotation step is assigned to the drill string rotation step based on the code value of the code being encoded onto the RPM value or duration of the drill string rotation step. In some embodiments, the duration of a drill string rotation step may be predetermined by the encoding scheme. In some embodiments, the duration of a drill string rotation step may represent a code value of a code of the message. In some embodiments, rotation controller 36 may be controlled automatically. In some embodiments, rotation controller 36 may be controlled manually.

In some embodiments, the predetermined encoding scheme may specify a message syntax based on the command to be sent. The message syntax may, for example and without limitation, define the number of drill string rotation steps to send the command. Each code of the series of codes may have an associated code value. In some embodiments, each code value may be encoded onto an RPM or duration of a drill string rotation step according to the predetermined encoding scheme. In some embodiments, the encoding scheme may therefore specify a number of drill string rotation steps, an RPM value for each drill string rotation step, and a duration for each drill string rotation step based on the command to be sent. In some embodiments, the duration of one or more drill string rotation steps may be specified based on the message syntax.

In some embodiments, the message may be encoded such that the RPM values of codes assigned to an RPM during a drill string rotation step is specified relative to a selected set point RPM. The set point RPM may, in some embodiments, be a baseline RPM against which other RPM values, as further discussed herein below, may be offset. In some embodiments, the set point RPM may additionally indicate to downhole tool 60 that a command is being communicated to downhole tool 60. The set point RPM may be selected based on, for example and without limitation, current operating conditions of drilling system 12 (207). In some embodiments, the set point RPM may be selected to avoid certain undesirable downhole dynamics, such as torsional vibration, stick slip, and/or whirl. For example, in some drilling operations, a low RPM of drill string 20 combined with a high weight on bit (WOB) may increase the occurrence of torsional vibration and/or stick slip. Similarly, high RPM and low WOB may increase the chance of whirl. In some embodiments, by monitoring real-time downhole dynamics data (e.g. stick-slip severities and/or whirl severities) communicated from, for example an MWD tool, a set point RPM may be selected to avoid unwanted downhole dynamics.

The set point RPM may thus be used as a baseline from which the RPM values of the drill string rotation steps are offset. Once the set point RPM is selected, the RPM at which to rotate drill string 20 during each drill string rotation step may be determined based on the offset from the selected set point RPM, depicted as determine RPM values (209) in FIG. 2. The set point RPM and encoded message may then be used to command rotation controller 36 to rotate drill string 20 to communicate the command to the downhole tool. In some embodiments, the drill string 20 may be rotated at or substantially at the set point RPM at a first drill string rotation step (211) to establish the set point RPM with downhole tool 60 as described herein below. The encoded message may then be transmitted by rotating drill string 20 consistent with each code value of the encoded message for each drill string rotation step in the encoded message (213).

In some embodiments, the encoded message may include an execute code at the end of the encoded message. In some embodiments, the execute code may be transmitted during a drill string rotation step that may include a rotation of drill string 20 at an execute RPM (215). The receipt of the execute code may, for example and without limitation, indicate that the transmission of the encoded message is complete and may instruct downhole tool 60 to execute the command. In some embodiments, the execute RPM may be preselected relative to the set point RPM.

As an example, FIGS. 3A-3G depict an exemplary representation of an encoding operation for a message consistent with embodiments as described herein. These figures depict RPM vs time for encoded message 300, and therefore also indicate the rotation of drill string 20 by rotation controller 36 as encoded message 300 is transmitted.

Figure 3A:
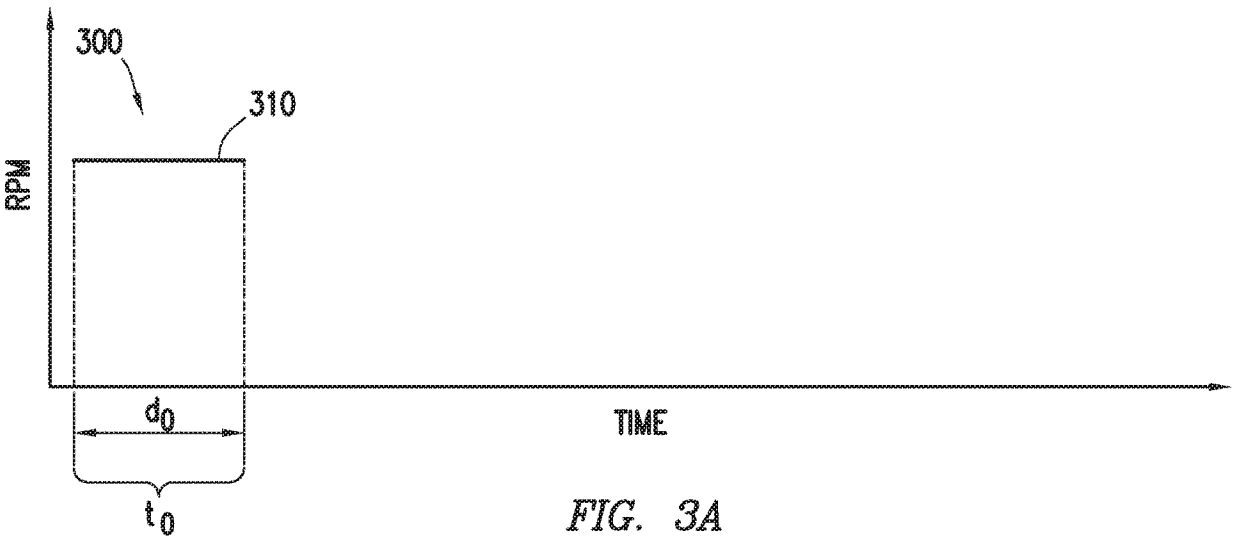
FIGS. 3A-3G depict an exemplary representation of an encoding operation for a message consistent with at least one embodiment of the present disclosure.

FIG. 3A depicts that, at a first drill string rotation step, depicted as to, drill string 20 may be rotated at set point RPM 310 for a first duration do. In some embodiments, set point RPM 310 may be recognized by downhole tool 60 when drill string 20 is rotated at an RPM for a predetermined duration. The rotation rate of drill string 20 may be limited to a particular range to be considered a set point RPM, for instance and without limitation, between 20 and 200 RPM, or between 60 and 160 RPM. The predetermined set point time period may range from at least 30 seconds to at least three minutes, or from at least one minute to at least two minutes, or at least about 1 minute 15 seconds. In certain embodiments, the set point RPM is not predefined, i.e., it may be set by the operator based on considerations such as current operating conditions of drilling system 12.

Figure 3B:
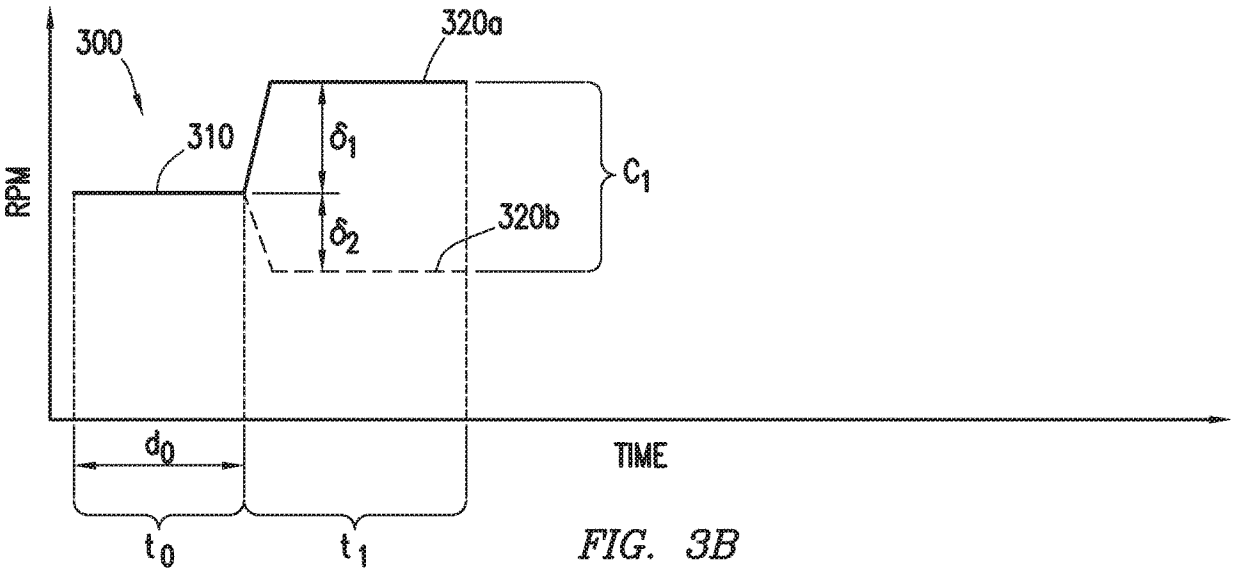

As depicted in FIGS. 3B-G, once the set point RPM 310 is transmitted, the codes of the encoded message may be transmitted. As an example, as depicted in FIG. 3B, a first code, $C_1$ is transmitted as an RPM at drill string rotation step $t_1$. In some embodiments, the RPM values for one or more of the codes in the code sequence may be set relative to the set point RPM. For example, for a first code, $C_1$, the possible $C_1$ code values may each be assigned to a different RPM value, depicted as 320*a*, 320*b*. Although only two RPM values 320*a*, 320*b* are depicted for drill string rotation step $t_1$, one having ordinary skill in the art with the benefit of this disclosure will understand that any number of RPM values may be assigned to different code values depending on the number of code values available for the code. For example, where code $C_1$ has code values of "modify toolface" or "modify offset", each code value may be assigned an RPM value, here 320*a*, and 320*b* respectively. In some embodiments, for example and without limitation, RPM value 320*a* may be set at a drill string rotation rate above the set point RPM 310 by a preselected offset $\delta_1$, and RPM value 320*b* may be set at a drill string rotation rate below the set point RPM by a preselected offset $\delta_2$. One having ordinary skill in the art with the benefit of this disclosure will understand that the offsets $\delta_1$ and $\delta_2$ may be equal or may be different without deviating from the scope of this disclosure.

For instance, and without limitation, RPM value 320*a* may be preset at 30 RPM greater than set point RPM 310. RPM value 320*b* may be preset at 30 RPM lower than set point RPM 310. As one of ordinary skill in the art with the benefit of this disclosure will appreciate, RPM values 320*a*, 320*b* may be preset at other values relative to set point RPM 310 than the example given herein.

Once set point RPM 310 is set, RPM values 320*a*, 320*b* may be set relative to set point RPM 310. For example, if set point RPM 310 is set at 100 RPM, based on the example provided above, RPM value 320*a* may be set to 130 RPM and RPM value 320*b* may be set to 70 RPM.

In some embodiments, in which $C_1$ is the only code to be sent to downhole tool 60, execute RPM may be transmitted after drill string rotation step $t_1$.

Figure 3C:
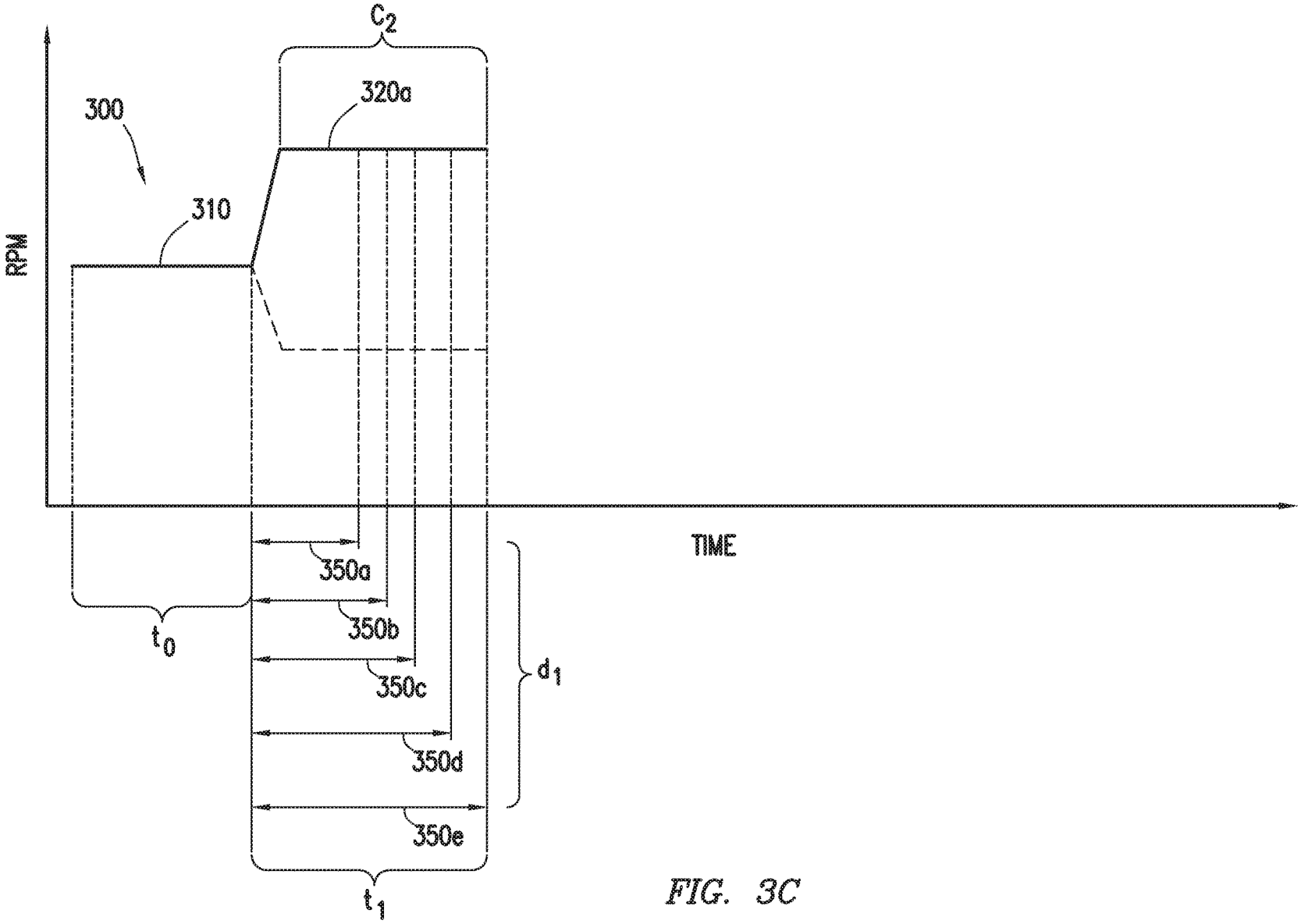

In some embodiments, as depicted in FIG. 3C, the possible code values for a code $C_2$ may each be assigned to a different duration $d_1$ of drill string rotation step $t_1$, depicted as durations 350*a*, 350*b*, 350*c*, 350*d*, and 350*e*. For example, where code $C_2$ has code values of "a coarse value only is being sent", "a fine value only is being sent", "coarse and fine values are being sent", "enter hold mode", "enter all pad/blade-extend mode", and "enter pad/blade-retract mode", each code value may be assigned to a different duration, 350*a*, 350*b*, 350*c*, 350*d*, and 350*e* respectively, for the duration $d_1$ of drill string rotation step $t_1$. Although five code values are described, one having ordinary skill in the art with the benefit of this disclosure will understand that any number of durations may be utilized depending on the number of code values to be assigned. In some embodiments, durations 350*a-e* may be separated by, for example and without limitation, 30 seconds.

In some embodiments, depending on the code value of code $C_2$ to be sent, drill string 20 may be rotated at the determined RPM value for code $C_1$, here 320*a*, for the duration $d_1$ corresponding to the code value to be sent. Therefore, for example, in order to send the encoded message for the command "Modify toolface, coarse and fine values are being sent", drill string 20 may be rotated at RPM value 320*a* for duration 350*b* during drill string rotation step $t_1$ as depicted in FIG. 3C.

Figure 3D:
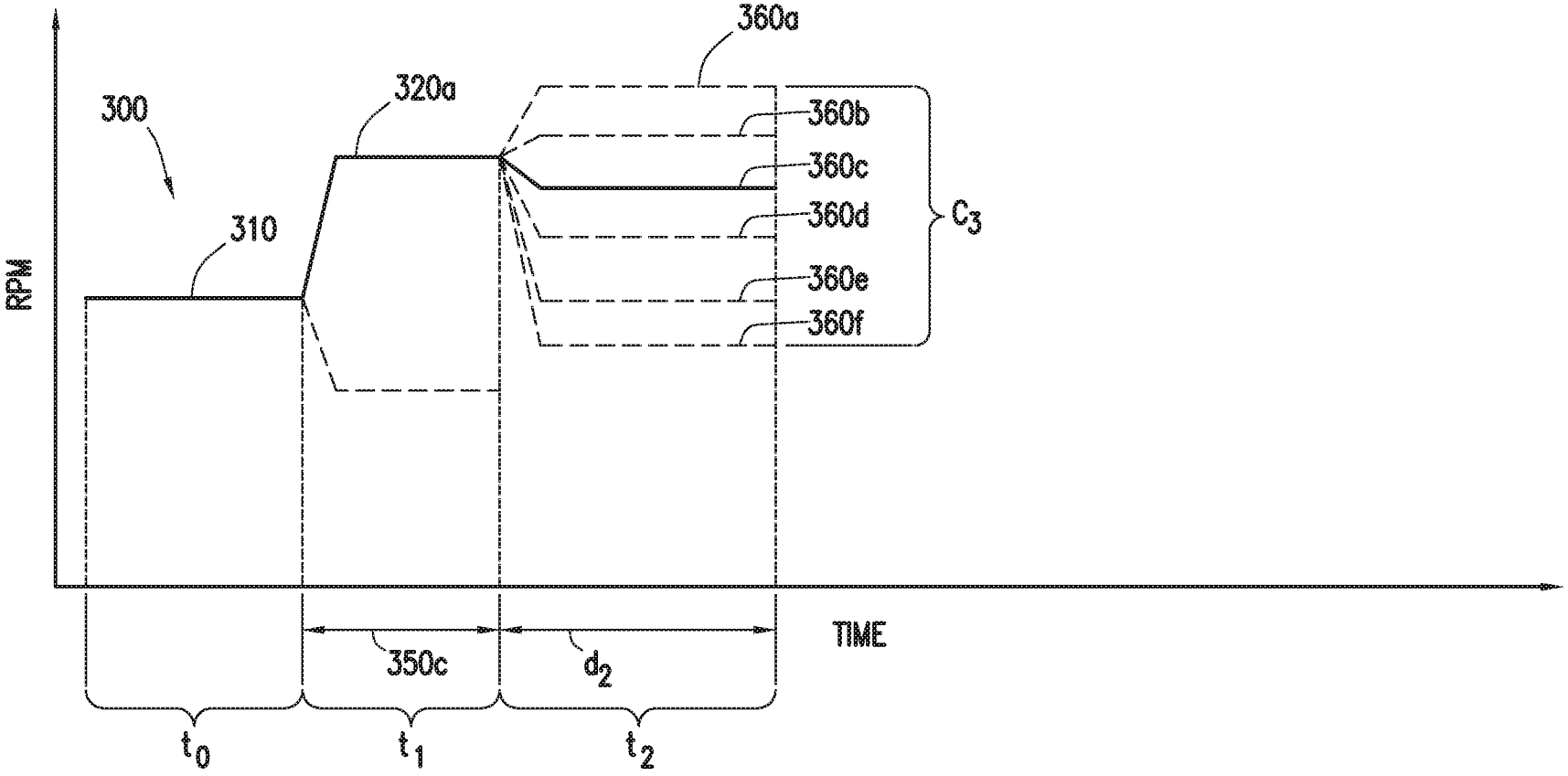
Figure 3E:
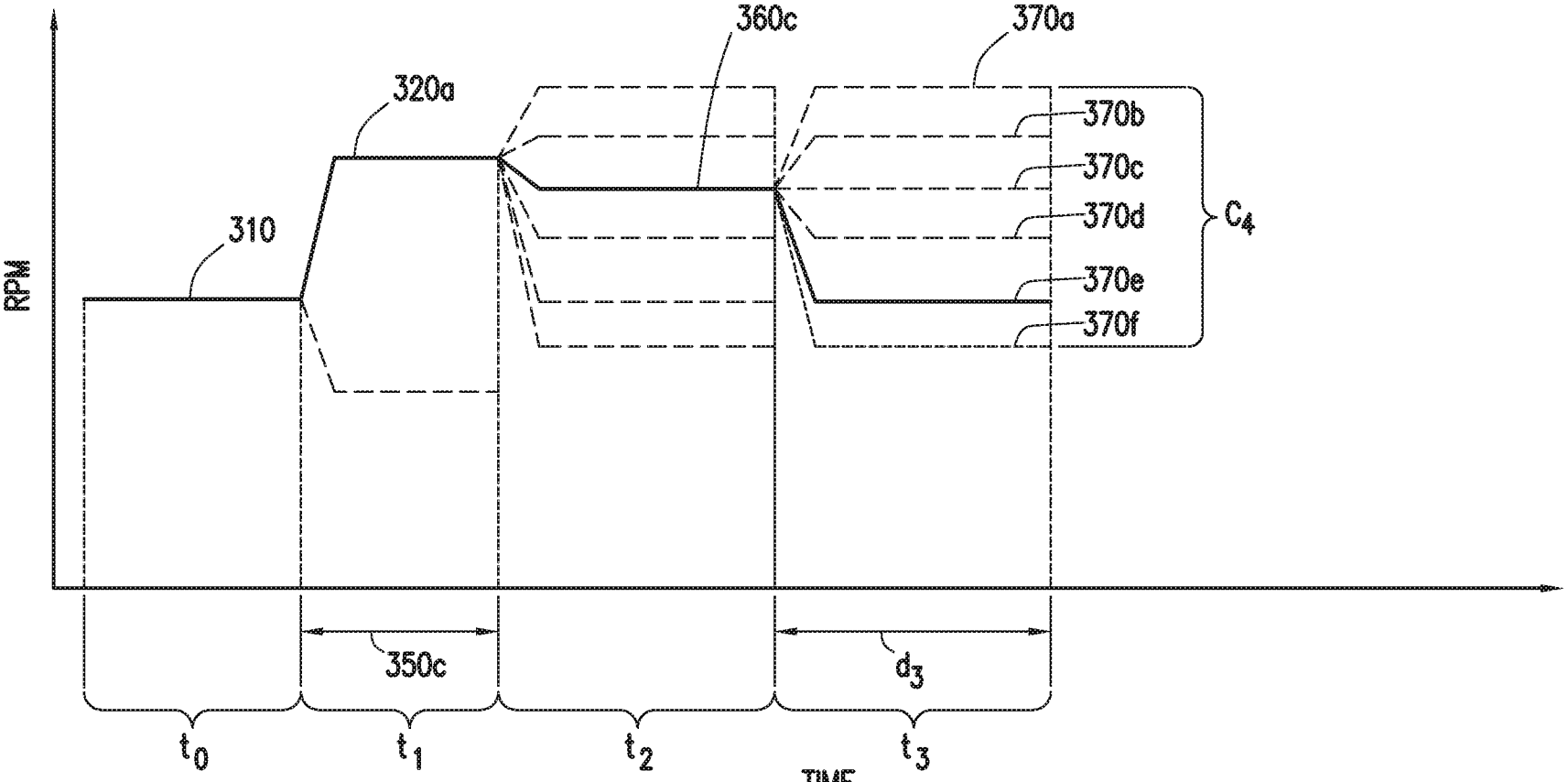

Any additional codes of the encoded message may be likewise encoded onto RPM values or durations for subsequent time periods. For example, FIG. 3D depicts code $C_3$ assigned to RPM values 360*a-f*, each representing a different code value of code $C_3$ to be transmitted in drill string rotation step $t_2$. RPM values 360*a-f* may be determined relative to set point RPM 310. In the exemplary embodiment above, where code $C_3$ is a coarse toolface code, each RPM value 360*a-f* may represent a different coarse toolface value. Similarly, FIG. 3E depicts code $C_4$ assigned to RPM values 370*a-f*, each representing a different code value of code $C_4$ to be transmitted in drill string rotation step $t_3$. In the exemplary embodiment above, where code $C_4$ is a fine toolface code, each RPM value 370*a-f* may represent a different fine toolface value. RPM values 370*a-f* may be determined relative to set point RPM 310. In some embodiments, one or more drill string rotation steps, such as drill string rotation steps $t_2$ and $t_3$, may be assigned predefined durations $d_2$ and $d_3$ respectively. In some embodiments, predefined durations $d_2$, $d_3$ may range from, for example, at least 30 seconds to at least 3 minutes, or from at least one minute to at least 2 minutes, or at least about 1 minute and 15 seconds.

In some embodiments, although not depicted, one or more additional codes may be assigned to the duration of a drill string rotation step as discussed with respect to code $C_2$ herein above.

For example, continuing the exemplary embodiment described above, to send the command "Modify toolface, coarse and fine values are being sent, 90° Left, −15°", where the code value for "coarse 90° Left" for $C_3$ is represented by RPM value 360*c* and the code value for "fine −15°" for $C_4$ is represented by RPM value 370*e*, drill string 20 may be rotated at RPM value 360*c* for duration $d_3$ during drill string rotation step $t_2$ as depicted in FIG. 3D and subsequently rotated at RPM value 370*e* for duration $d_4$ during drill string rotation step $t_3$ as depicted in FIG. 3E.

Figure 3F:
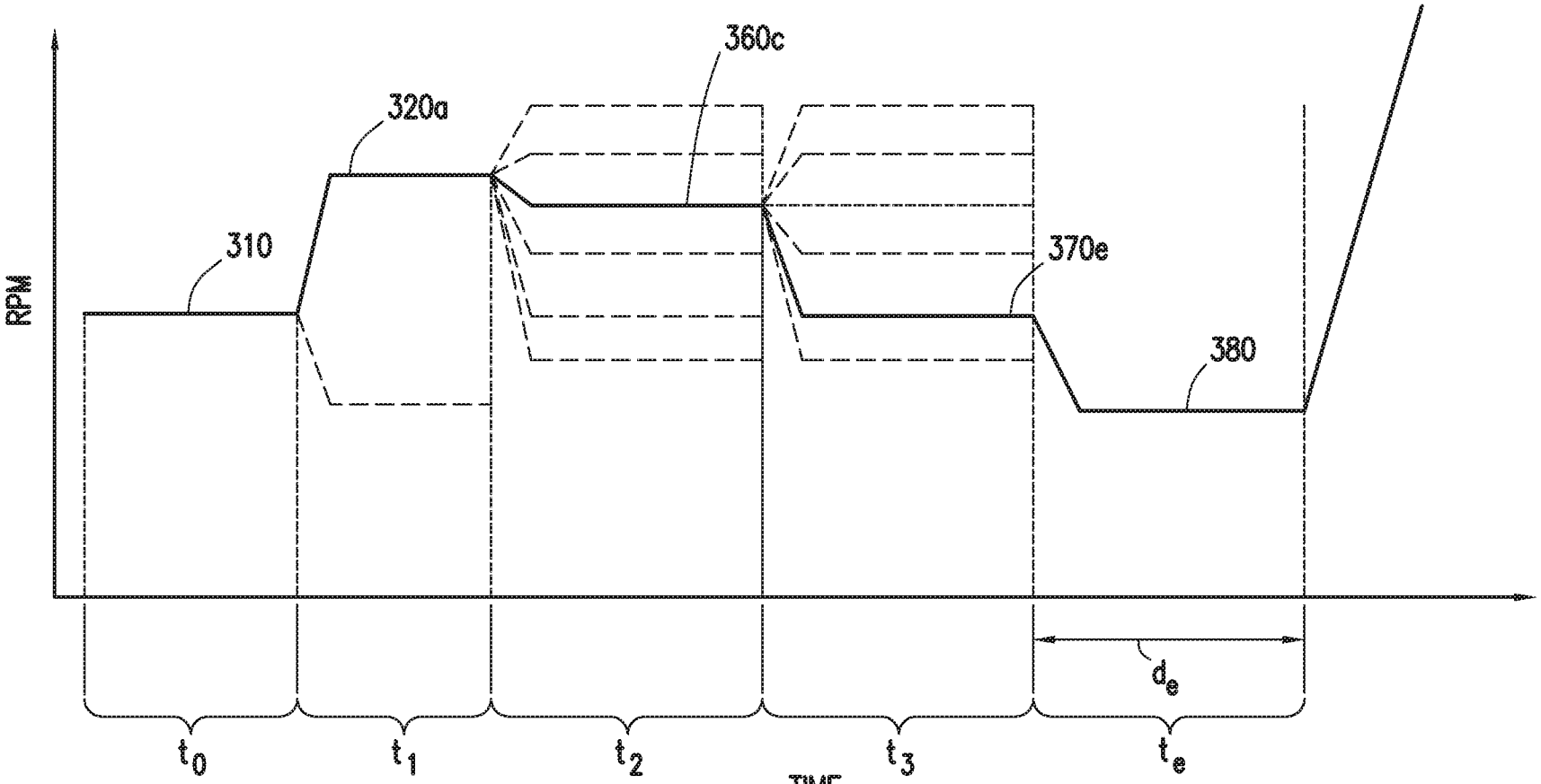

Once all codes to be sent have been sent, as previously discussed, drill string 20 may be rotated at execute RPM, depicted in FIG. 3F as RPM value 380 during drill string rotation step to for duration de. In some embodiments, duration de may be predefined as previously discussed. Although four codes $C_1$-$C_4$ are described herein, one having ordinary skill in the art with the benefit of this disclosure will understand that any number of codes in encoded message may be transmitted without deviating from the scope of this disclosure.

Figure 3G:
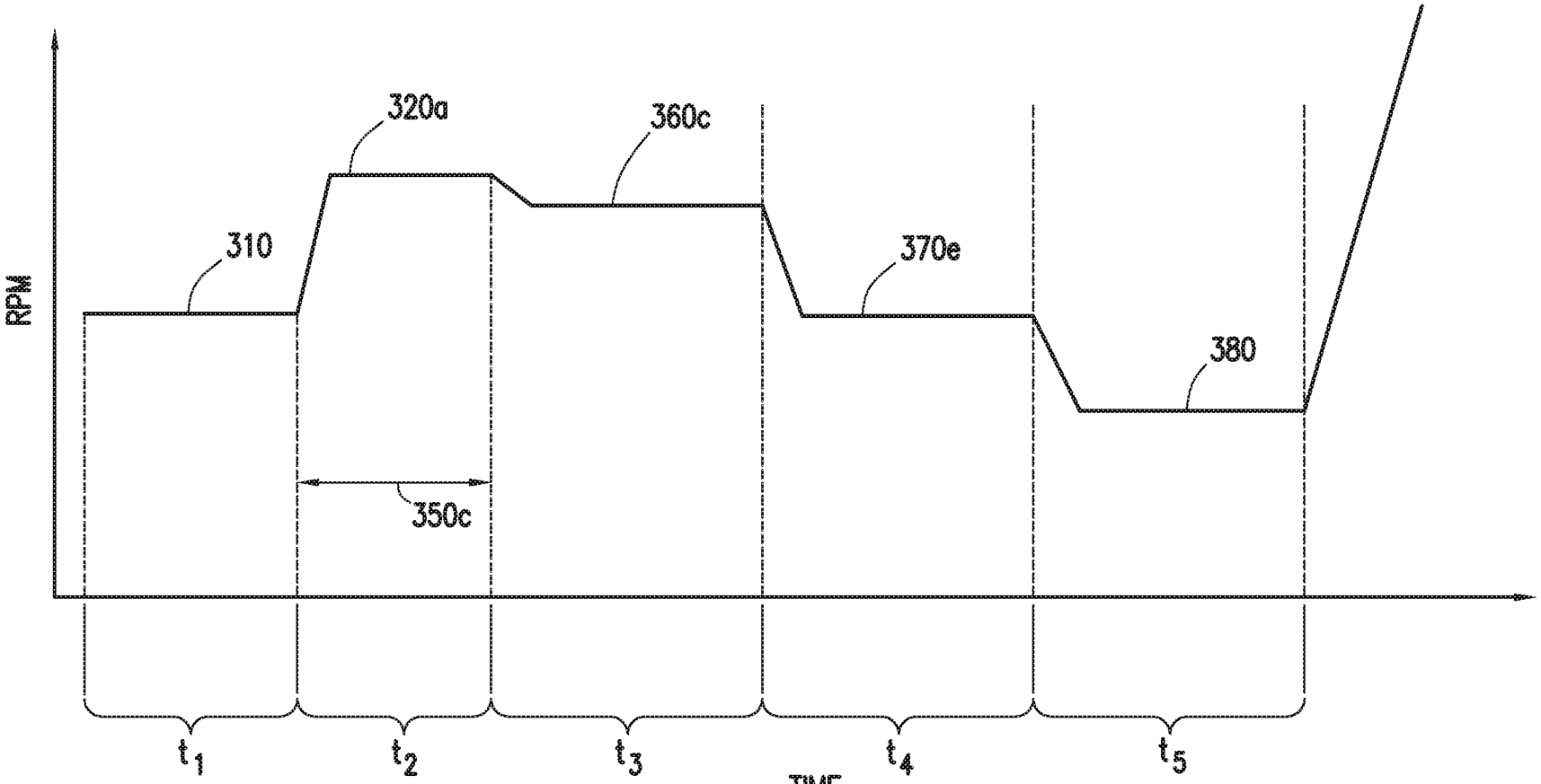

To transmit encoded message 300, rotation controller 36 may direct drill string 20 to rotate in accordance with the above discussed RPM values and durations for each drill string rotation step. The final encoded message 300 as transmitted by rotation controller 36 is depicted in FIG. 3G, which includes set point RPM 310 and RPM values 310, 320*a*, 360*c*, 370*e*, and 380 at drill string rotation steps $t_1$, $t_2$, $t_3$, $t_4$, $t_5$, respectively.

In some embodiments, downhole tool 60 may include one or more rotation rate sensors 32. Rotation rate sensors 32 may be used to measure the rotation rate of drill string 20 at the location of rotation rate sensor 32 along drill string 20. Depending on the type and configuration of downhole tool 60, one or more rotation rate sensors 32 may, in some embodiments, be positioned on one or more of a part of downhole tool 60 which rotates with drill string 20, on a part of downhole tool 60 which remains generally stationary with respect to wellbore 14, a part of downhole tool 60 which rotates at a different rate than drill string 20 relative to wellbore 14, or a part of downhole tool 60 which may rotate or not rotate depending on the operating mode of downhole tool 60 or operating conditions in wellbore 14. In some embodiments, rotation rate sensor 32 may include, for example and without limitation, one or more accelerometers, magnetometers, and/or gyroscopic (angular-rate) sensors, including micro-electro-mechanical system (MEMS) gyros and/or others operable to measure cross-axial acceleration and/or magnetic field components. In some embodiments, where rotation rate sensor 32 rotates with drill string 20, the RPM measured by such a rotation rate sensor 32 may directly indicate the RPM of drill string 20.

In some embodiments, a marker may be located on drill string 20 or an attachment to drill string 20 that rotates with drill string 20 and rotation rate sensor 32 may be located on a portion of downhole tool 60 which remains generally stationary with respect to wellbore 14, rotates at a different rate than drill string 20, or may rotate or not rotate depending on the operating mode of downhole tool 60. Rotation rate sensor 32 may sense the marker as the marker rotates past rotation rate sensor 32 to determine the relative rotation rate between the nonrotating or slowly rotating part of downhole tool 60 and drill string 20. In certain embodiments, the marker may be a magnet and the rotation rate sensor a Hall-effect sensor, a fluxgate magnetometer, a magneto-resistive sensor, a MEMS magnetometer, and/or a pick-up coil. In other embodiments rotation rate sensor 32 may be an infra-red sensor and the marker a mirror reflecting light from a source located near rotation rate sensor 32. In yet other embodiments, rotation rate sensor may be an ultrasonic sensor that may detect the marker. In some embodiments, where downhole tool 60 remains generally stationary with respect to wellbore 14, the relative rotation rate measured by such a rotation rate sensor 32 may directly indicate the RPM of drill string 20.

In embodiments where downhole tool 60 may rotate at a different speed than drill string 20, a combination of rotation rate sensors 32 may be utilized. For example, one or more accelerometers, magnetometers, and/or gyroscopic sensors may be used to determine the absolute rotation rate of downhole tool 60, and a Hall-effect sensor, a fluxgate magnetometer, a magneto-resistive sensor, a MEMS magnetometer, or a pick-up coil may determine the relative rotation rate between downhole tool 60 and drill string 20. The RPM of drill string 20 may thus be calculated according to:

$$dRPM=aRPM+rRPM$$

where dRPM is the RPM of drill string 20, aRPM is the absolute rotation rate of downhole tool 60, and rRPM is the relative rotation rate between drill string 20 and downhole tool 60.

In some embodiments, the measured RPM value from rotation rate sensor 32 may be filtered to, for example, suppress noise and other erroneous values from the RPM values measured including, for example and without limitation, stick-slip and torsional vibration. Such filtering may, in some embodiments, be accomplished by one or more of an analog filter, a digital filter, or combinations thereof. In some embodiments, the filter may include, for example and without limitation, one or more of a non-linear filter such as a median filter, a linear filter such as an infinite impulse response (IIR) filter or a finite impulse response (FIR) filter), or combinations thereof.

In some embodiments, where downhole tool 60 is a powered RSS, motor-assisted RSS, turbine assisted RSS, or gear-reduced turbine assisted RSS, a flow-modulated downlink signal may be received from the shaft RPM changes at downhole tool 60. In such an embodiment, rotation of drill string 20 as discussed herein may refer to the rotation of a drive shaft below a mud motor, turbine, or gear-reduced turbine, wherein the message is modulated onto a drilling mud flow rate at surface 5. In some embodiments, such flow rate may be computer-controlled by equipment located at surface 5. In some embodiments, messages may be sent while conventional mud pulse telemetry is in operation for uplinking, without interrupting uplink communications, which may allow simultaneous uplink and downlink communications.

In some embodiments, rotation rate sensor 32 may be in data connection with downhole decoder 33. Downhole decoder 33 may measure drill string rotation from rotation rate sensor 32. In some embodiments, downhole decoder 33 may be configured to receive and interpret the command of the encoded message as described herein above based on measured RPM values of drill string 20.

Figure 4:
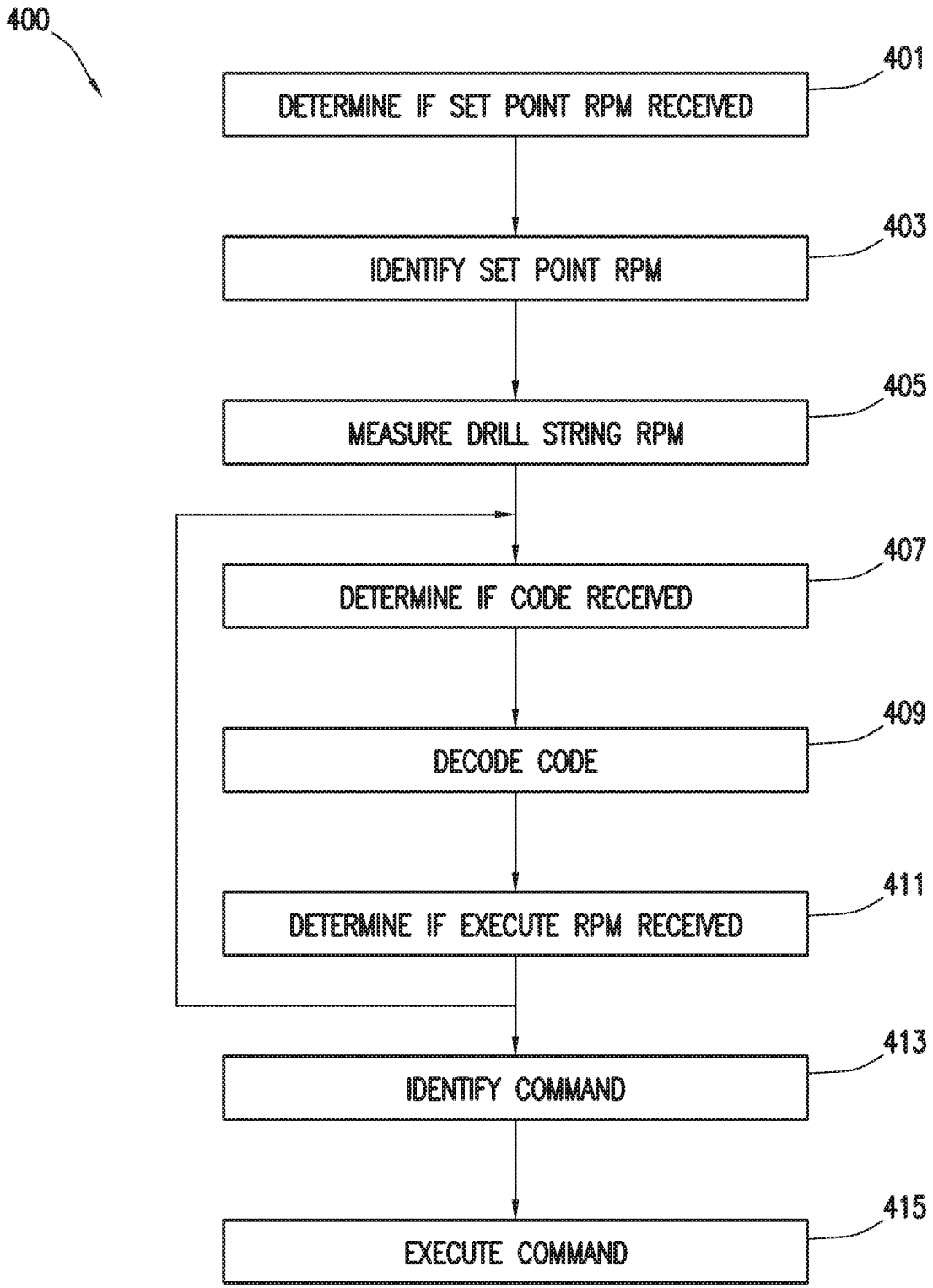
FIG. 4 depicts a flow chart of a command reception operation consistent with at least one embodiment of the present disclosure.

As an example, FIG. 4 depicts a flow chart of a message reception operation 400 consistent with at least one embodiment of the present disclosure in which a command from the surface 5 is received by downhole tool 60. Downhole decoder 33 may monitor the rotation of drill string 20 during drilling operations. In some embodiments, downhole decoder 33 may sample the rotation of drill string 20, to determine if a set point RPM has been received (401). For example, downhole decoder 33 may determine if a set point RPM is received by identifying that the rotation rate of drill string 20 remains generally constant for a time period equal to duration do as described herein above. As used herein, a rotation rate is considered "generally constant" if the rotation rate of drill string 20 does not vary more than 7 RPM, 5 RPM, or 3 RPM over the course of duration do.

Once it is determined that a set point RPM has been received, the set point RPM may be identified (403). Downhole decoder 33 may continue to measure the RPM of drill string 20 to receive the codes of the encoded message described herein above (405). Downhole decoder 33 may subsequently determine if a code is received (407). In some embodiments, downhole decoder 33 may determine if a code is received by identifying whether the RPM of drill string 20 corresponds with a code value of a command available to be received by downhole tool 60. In some embodiments, for example and without limitation, based on the identified set point RPM, downhole decoder 33 may determine that a code has been received if the RPM of drill string 20 remains generally constant within an RPM window about an RPM value based on the set point RPM corresponding with a code value of the message available to be received by downhole tool 60 for a preselected duration. In some embodiments, the preselected duration may be of fixed width. In some embodiments, downhole decoder 33 may measure the duration of the generally constant RPM of drill string 20 to identify a code value of a code of the encoded message which is encoded onto the duration of a drill string rotation step as previously discussed.

Once downhole decoder 33 determines that a code has been received, downhole decoder 33 may decode the received code (409). Downhole decoder 33 may repeat the procedure for each code received until the execute RPM is determined to have been received (411). Downhole decoder 33 may then assemble the received codes and identify the received command (413). Downhole decoder 33 may then execute the command (415).

Figure 5A:
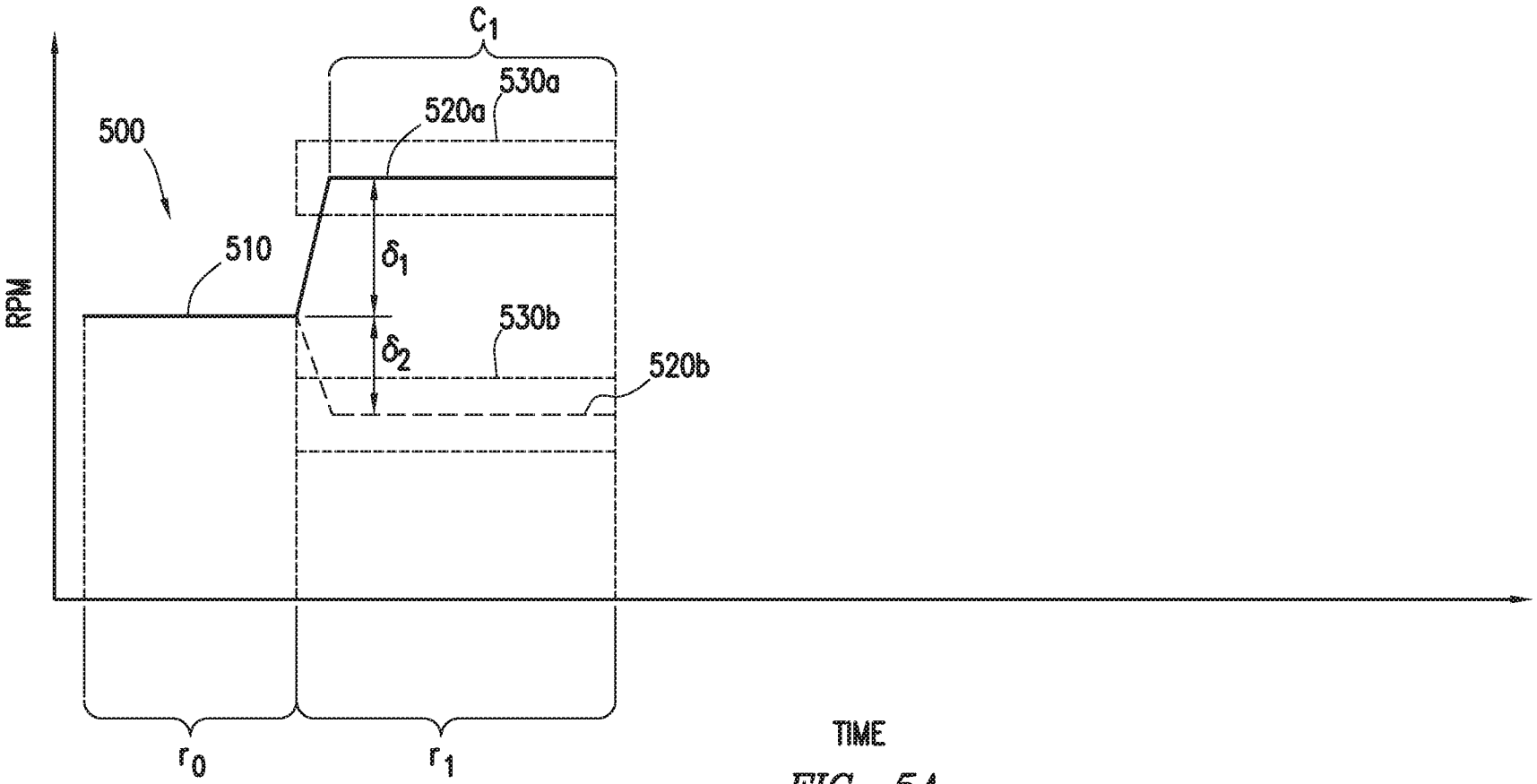
FIGS. 5A-5E depict an exemplary representation of a decoding operation for a message consistent with at least one embodiment of the present disclosure.

In some embodiments, downhole decoder 33 may decode the received code by comparing the RPM value of the received code with the identified set point RPM. In some embodiments, downhole decoder 33 may establish an RPM window for each possible code to be received for each drill string rotation step. As an example, FIGS. 5A-5E depict an exemplary representation of a decoding operation for a message consistent with embodiments as described herein. These figures depict RPM vs time for received RPM value 500, and therefore also indicate the rotation of drill string 20 received by downhole decoder 33 as encoded message 300 is received. In some embodiments, as depicted in FIG. 5A, once set point RPM 510 is determined to be received at receiver time slot $r_0$, the RPM value of set point RPM 510 may be identified. In some embodiments, set point RPM 510 may be determined to be received if the measured RPM of drill string 20 remains within an RPM window for the preselected duration do of receiver time slot $r_0$.

In some embodiments, once set point RPM 510 is identified, downhole decoder 33 may monitor received RPM value 500 to determine if an additional code is received. In some embodiments, as previously discussed with regard to FIGS. 3A-3G, RPM values may be assigned to each possible code value of a code to be transmitted. Downhole decoder 33 may therefore monitor received RPM value 500 to identify a time period in which received RPM value 500 remains at an RPM relative to the set point RPM 510 consistent with a possible RPM value assigned to a possible code value of a code for a predefined duration during receiver time slot $r_1$. In some embodiments, RPM windows 530*a*, 530*b* may be established, each corresponding with an RPM value associated with a possible code value of an expected code, represented as RPM windows 520*a*, 520*b*. For example, as depicted in FIG. 5A, RPM windows 520*a*, 520*b* may represent the possible $C_1$ code values as previously discussed. For example, where code $C_1$ has code values of "modify toolface" or "modify offset", RPM windows 520*a*, 520*b* may be assigned respectively thereto. RPM windows 520*a*, 520*b* may be determined based on the preselected offsets 61 and 62 as previously discussed. In some embodiments, RPM windows 530*a*, 530*b* may include RPM values within a certain range about the RPM value offset by $\delta_1$ and $\delta_2$ from set point RPM 510. In some embodiments, RPM windows 520*a*, 520*b* may, for example and without limitation, allow RPM values within 15 RPM, 10 RPM, or 5 RPM faster or slower than the determined RPM to be identified as the expected RPM value for each code value. In some embodiments, by identifying with which RPM window 520*a*, 520*b* the received RPM 500 corresponds, the code value of the code associated with the RPM value during receiver time slot $r_1$, here code $C_1$, may be determined.

Figure 5B:
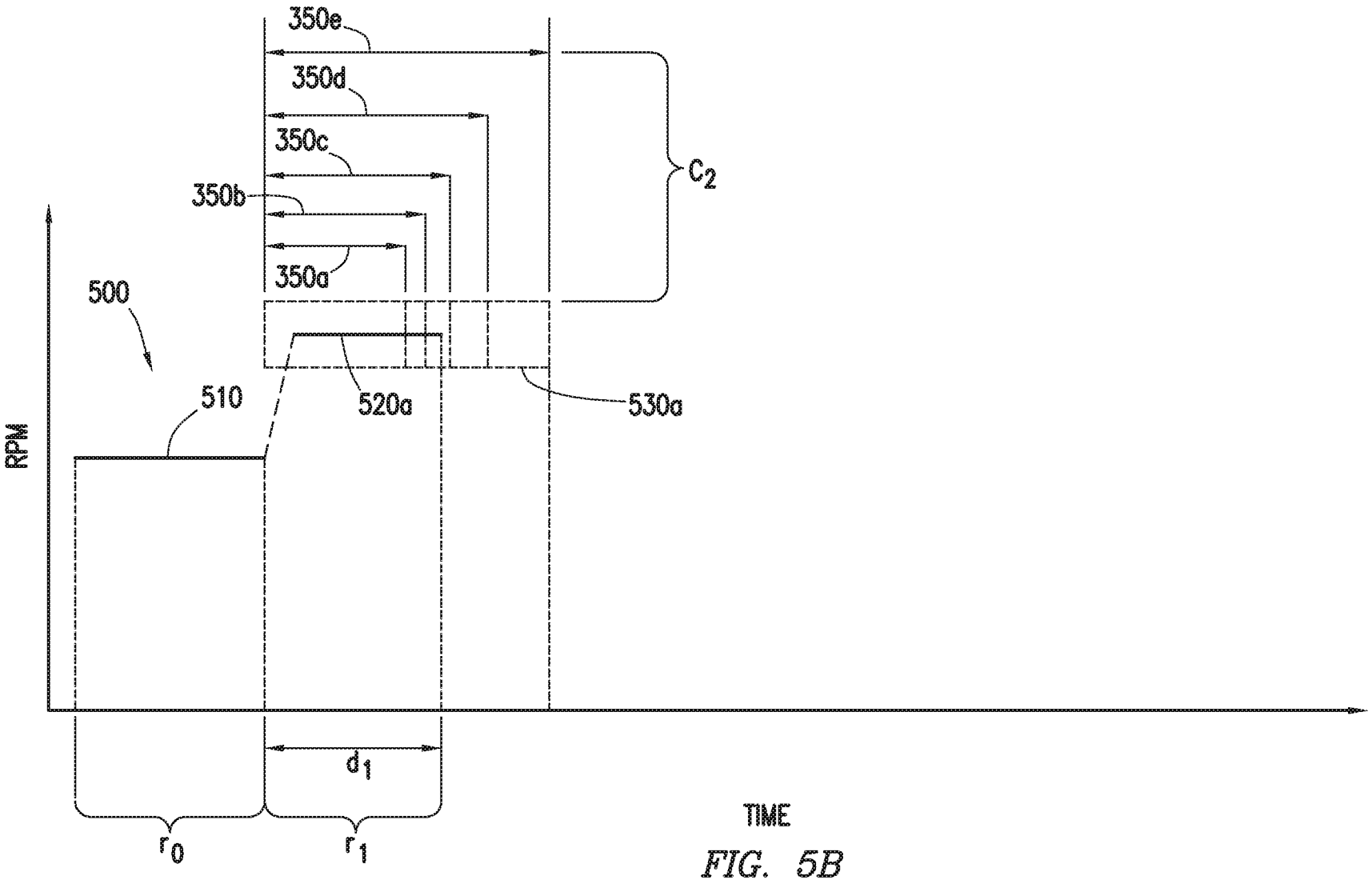

In some embodiments, as depicted in FIG. 5B, downhole decoder 33 may also measure the length of time of the receiver time slot during which the RPM value is transmitted to determine the duration of drill string rotation during receiver time slot $r_1$, corresponding with possible durations such as durations 350*a*, 350*b*, 350*c*, 350*d*, and 350*e* as previously discussed. By measuring the length of receiver time slot $r_1$, the value of the code associated with the duration of receiver time slot $r_1$, here code $C_2$, may be determined. For example, where code $C_2$ has code values of "a coarse value only is being sent", "a fine value only is being sent", "coarse and fine values are being sent", "enter hold mode", and "enter pad retract mode", where each code is assigned to a different duration, 350*a*, 350*b*, 350*c*, 350*d*, and 350*e* respectively, the determined duration of receiver time slot $r_1$ may be used to identify the code value of code $C_2$.

In some embodiments, one or more received codes may be used to identify a message syntax for downhole decoder 33. In some such embodiments, for example, downhole decoder 33 may identify the type of command to be received and the syntax associated therewith. As an example, where, as depicted in FIG. 5B, measured RPM 500 corresponds with RPM window 530*a* for a time corresponding to duration 350*c*, downhole decoder may decode the codes from the predetermined encoding scheme corresponding with the associated code values. For example and without limitation, as in the previous examples, RPM window 530*a* and duration 350*c* may be identified as "Modify toolface, coarse and fine values are being sent."

Based on the decoded codes, downhole decoder 33 may determine what code or codes should be expected during the message. For example, where codes $C_1$ and $C_2$ contain an entire message, downhole decoder 33 may expect an execution code immediately. Where codes $C_1$ and $C_2$ indicate that additional codes are being transmitted, downhole decoder 33 may establish RPM windows for the subsequent receiver time steps to be utilized to receive the additional codes.

Figure 5C:
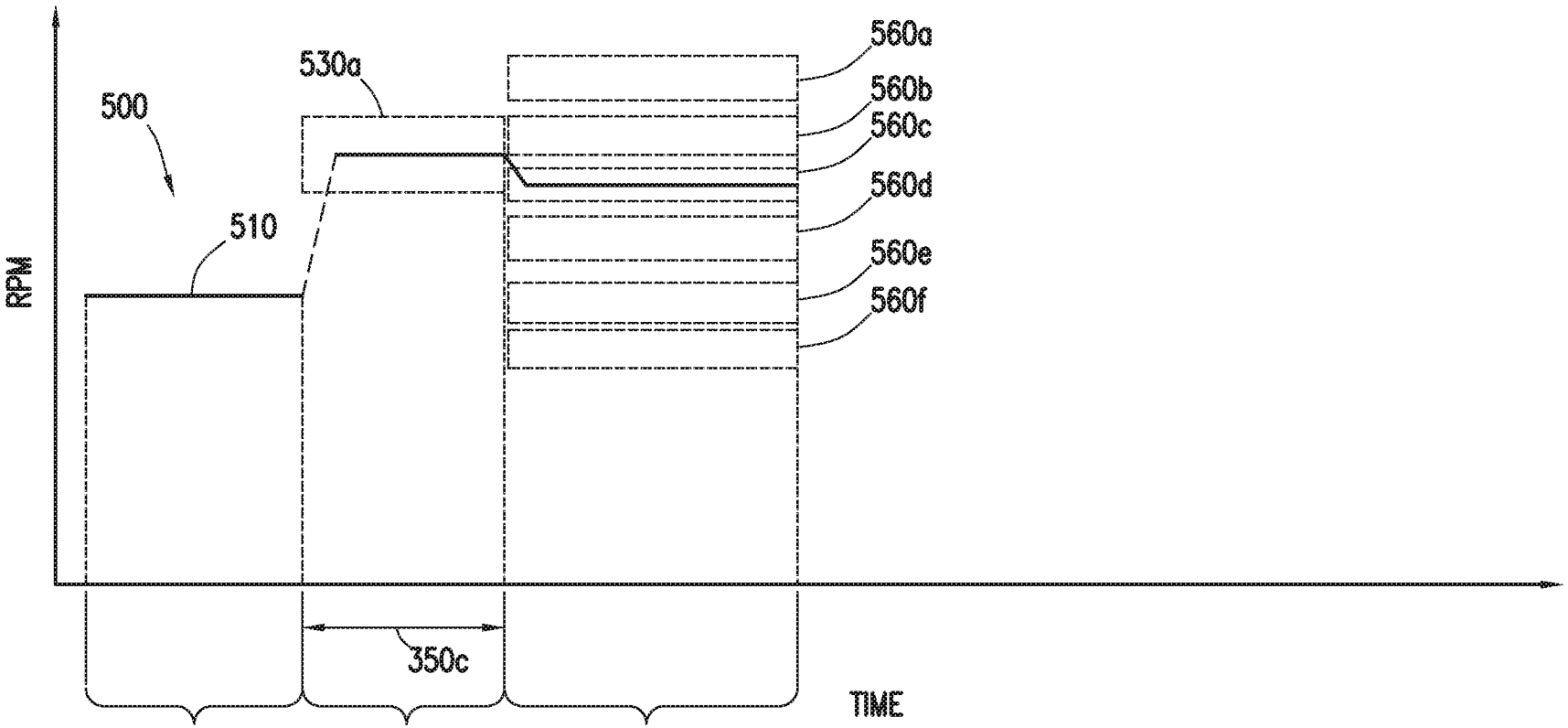
Figure 5D:
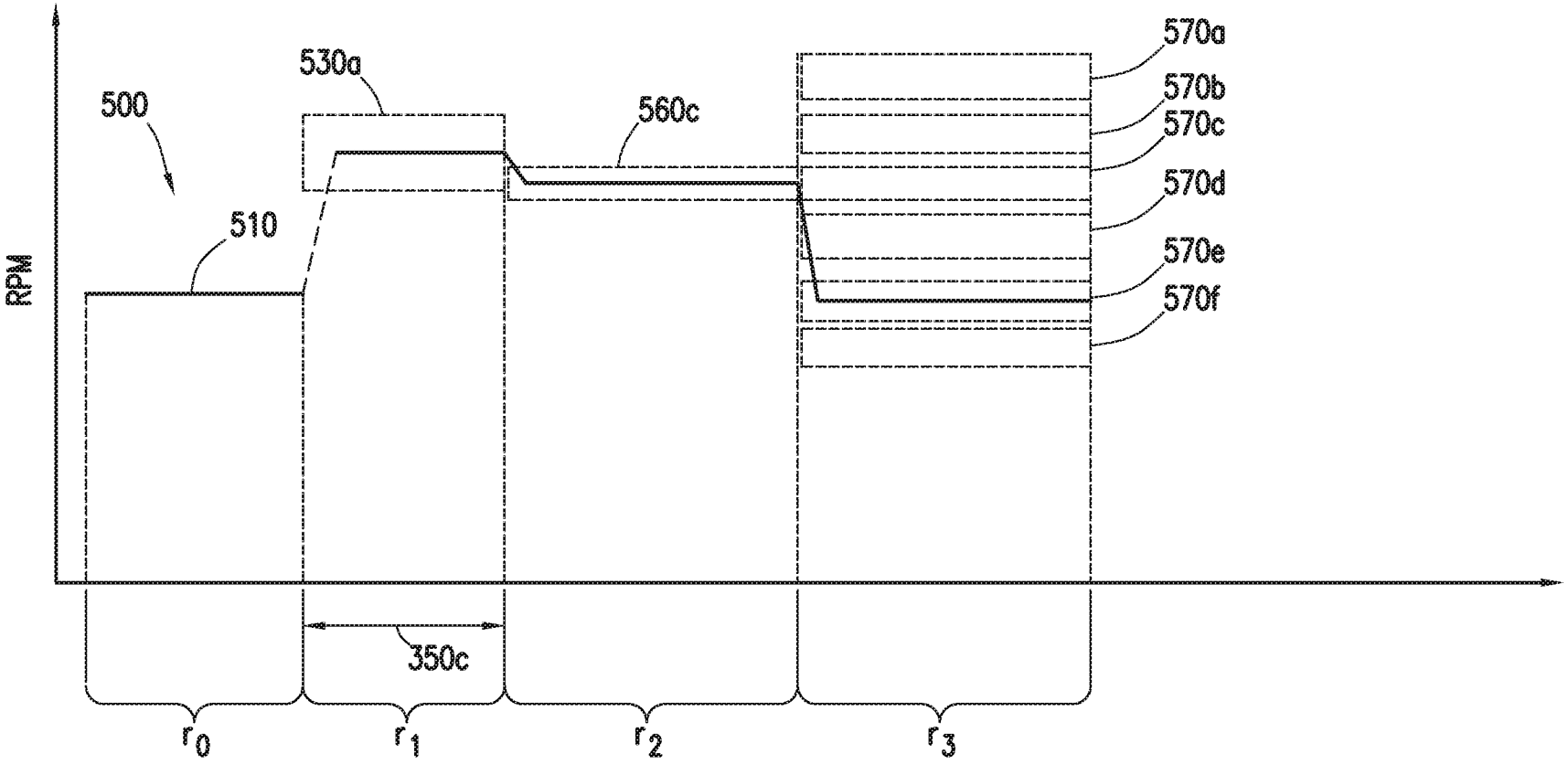

For example, as depicted in FIG. 5C, RPM windows 560*a-f* may be established during receiver time slot $r_2$ for the possible RPM values corresponding to the possible code values of code $C_3$ as previously discussed relative to the identified set point RPM 510. In the exemplary embodiment above, where code $C_3$ is a coarse toolface code, each RPM window 560*a-f* may represent a different coarse toolface value. Similarly, FIG. 5D depicts code $C_4$ assigned to RPM windows 570*a-f*, each representing a different code value of code $C_4$ received by downhole decoder 33 during receiver time slot $r_3$. In the exemplary embodiment above, where code $C_4$ is a fine toolface code, each RPM window 570*a-f* may represent a different fine toolface value. RPM windows 570*a-f* may be determined relative to set point RPM 510.

Once all expected codes are identified, downhole decoder may establish execute RPM window 580. Execute RPM may be considered to be received if measured RPM 500 during the receiver time slot in which execute RPM window 580 is positioned, here receiver time slot $r_e$, remains within execute RPM window 580.

In some embodiments, once the execute RPM is received, downhole decoder 33 may decode any remaining codes remaining to be decoded. Downhole decoder 33 may identify the command from the codes of the encoded message. Downhole decoder 33 may instruct downhole tool 60 to execute the command.

Figure 5E:
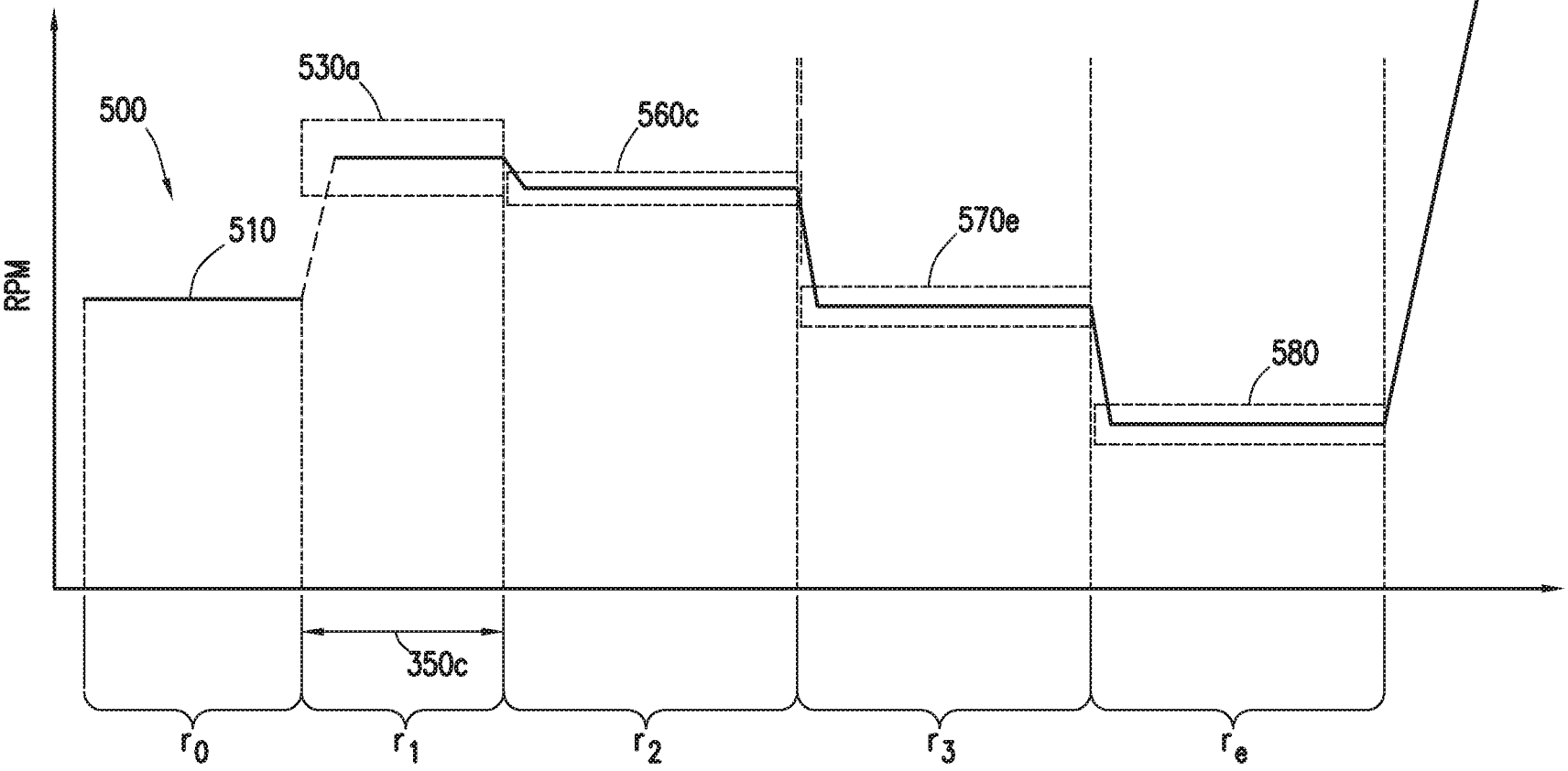

As an example, as depicted in FIG. 5E, received RPM 500 may be decoded in terms of the RPM windows in which its RPM value falls during each receiver time step. In the example shown in FIG. 5E, the received RPM 500 passes through RPM window 530*a* for a duration of 350*c*, RPM window 560*c*, RPM window 570*e*, and execute RPM window 580 (at receiver time slot $r_e$). Downhole decoder 33 may interpret received RPM 500 to identify the command "Modify toolface, coarse and fine values are being sent, 90° Left, −15°".

In some embodiments in which the received RPM 500 does not pass through one or more RPM windows, downhole receiver 33 may, for example and without limitation, reject the incoming message as improperly formed. In some embodiments, by ensuring the received RPM 500 complies with the expected commands, spurious signals or erroneous messages may be ignored.

In some embodiments, downhole decoder 33 may only recognize that an RPM value is in an RPM window if the RPM value is maintained for a predefined duration. The predefined duration may range from, for example, at least 30 seconds to at least 3 minutes, or from at least one minute to at least 2 minutes, or at least about 1 minute and 15 seconds.

In some embodiments, downhole decoder 33 may communicate with other downhole tools included in drill string 20. For example and without limitation, in some embodiments, downhole decoder 33 may communicate with one or more telemetry systems that communicate with surface 5 or a short hop communication system for two-way communication across a downhole motor or turbine. In some embodiments, rotation controller 36 may run a closed-loop control configuration. In some embodiments, rotation controller 36 may communicate with a downhole closed-loop system, such as if downhole tool 60 is in a hold mode as previously described, to change the target value of downhole tool 60. One having ordinary skill in the art with the benefit of this disclosure will understand that downhole decoder 33 need not necessarily be located in a rotary steerable tool, but may be positioned elsewhere in drill string 20 and may be in electronic communication therewith. Moreover, one skilled in the art with the benefit of this disclosure will recognize that the multiple downlink decoding functions described above may be distributed among a number of downhole tools 60 or a number of electronic devices or controllers. For example and without limitation, a first controller may be designed to measure raw RPM, a second controller may filter the raw RPM measurement, a third controller may decode the message, and a fourth controller, such as a controller for an RSS, may execute the command identified from the received encoded message. In some such embodiments, the controllers may be connected to a common communication bus, and in some embodiments, intermediate parameters may be communicated among these controllers. In some embodiments, the controllers may be positioned in a bottom hole assembly (BHA).

Figure 6:
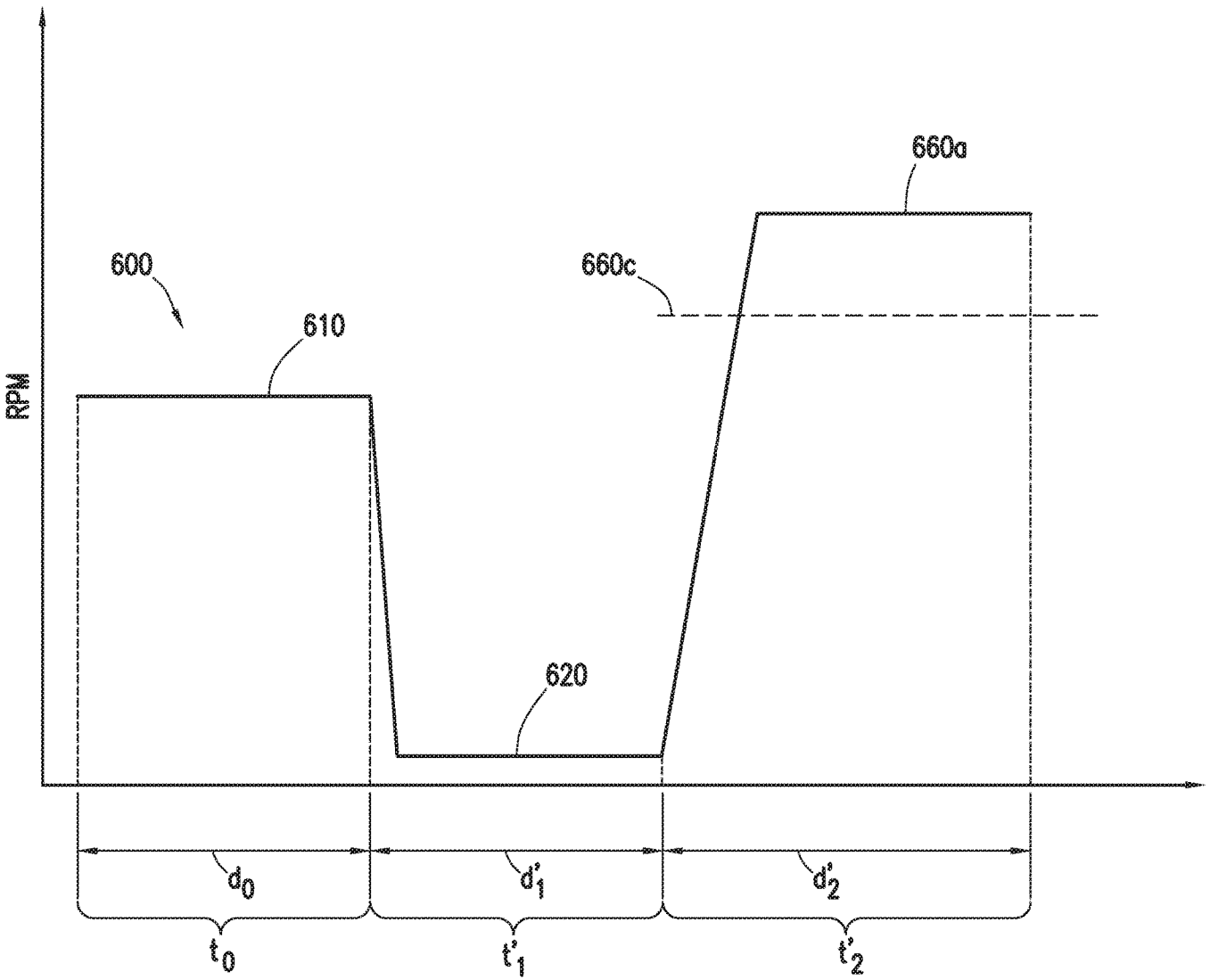
FIG. 6 depicts an exemplary representation of an encoded message consistent with at least one embodiment of the present disclosure.

In some embodiments, the command may include a change in mode for downhole tool 60. In some such embodiments, such as, for example and without limitation, where a wake-up command is to be communicated, an encoded message 600 as depicted in FIG. 6 may be utilized. At a first drill string rotation step $t_0$, drill string 20 may be rotated at a set point RPM 610 for a preselected duration $d_0$ as previously described. The RPM of drill string 20 may then be reduced to zero RPM or nearly zero RPM 620 at drill string rotation step $t'_1$ for a predetermined duration $d'_1$. For the purposes of this disclosure, in some embodiments, nearly zero RPM may refer to a rotation rate less than, for example and without limitation, 20 RPM, 10 RPM, or 5 RPM. The RPM of drill string 20 may then be increased to an RPM value 660*a* above a predetermined wakeup threshold RPM value 660*c* during drill string rotation step $t'_2$ for a predetermined duration $d'_2$. In some embodiments, wakeup threshold RPM value 660*c* may be determined based on set point rpm 610. In some embodiments, RPM value 660*a* may be a certain value above wakeup threshold RPM value 660*c*. For example and without limitation, RPM value 660*a* may be at least 10 RPM higher than wakeup threshold RPM value 660*c*. In some embodiments, although not depicted, drill string 20 may be reduced to a zero or near zero RPM after drill string rotation step $t'_2$. Encoded message 600 may be received by downhole tool 60 as previously discussed herein. The use of a zero or nearly zero RPM 620 may, for example and without limitation, avoid an inadvertent interpretation by downhole tool 60 that a wakeup command has been sent.

Although systems and methods for communicating information from the surface to equipment located in a borehole and their advantages thereof have been described in detail, it should be understood that various changes, substitutions and alterations may be made herein without departing from the spirit and scope of the disclosure as defined by the appended claims.

The invention claimed is:

1. A method for communicating a command into a wellbore from the surface comprising:

providing a downhole tool, the downhole tool coupled to a drill string, the drill string rotated by a top drive at the surface, the downhole tool including a downhole decoder and a drill string rotation rate sensor, the top drive controlled by a rotation controller;

determining a command to be sent to the downhole tool;

translating the command into a message, the message including a sequence of codes, the sequence of codes including an execute code, the execute code at the end of the message;

selecting a set point RPM;

encoding the message based on a predetermined encoding scheme, each code of the sequence of codes of the message encoded onto an RPM value, the RPM value offset from the set point RPM, or duration of a drill string rotation step;

rotating the drill string substantially at the set point RPM for a predetermined duration;

measuring the rotation rate of the drill string;

determining by the downhole decoder that the rotation rate of the drill string remains generally constant for the predetermined duration to determine if a set point RPM has been received;

identifying the received set point RPM with the downhole decoder;

rotating the drill string consistent with a first code value of a first code of the message as encoded;

decoding the first code;

rotating the drill string consistent with a second code value of a second code of the message as encoded;

decoding the second code;

identifying the command from at least one of the decoded first and second code rotating the drill string at an execute RPM, defining the execute code;

determining that the execute code has been received by the downhole decoder; and executing the command once the downhole decoder determines that the execute code has been received.

2. The method of claim 1, wherein the downhole tool is one of a directional drilling tool, a rotary steerable system, a turbine assisted rotary steerable system, a gear-reduced turbine assisted rotary steerable system, a rotary steerable motor, a steerable coiled tubing tool, a steerable motor, a steerable turbine, a vibratory tool, an oscillation tool, a friction reduction tool, a shock tool, a vibration/shock damper tool, a jarring tool, or a reamer.

3. The method of claim 1, wherein the drill string rotation rate sensor comprises one or more of an accelerometer, magnetometer, gyroscopic sensor, or combinations thereof.

4. The method of claim 1, wherein the downhole tool comprises:

a magnetic marker coupled to the drill string, and a Hall-effect sensor, a fluxgate magnetometer, a magnetoresistive sensor, a MEMS magnetometer, or a pick-up coil positioned to sense the magnetic marker as the marker rotates.

5. The method of claim 1, wherein the rotation controller is manually controlled.

6. The method of claim 1, wherein the drill string rotation rate sensor is automatically controlled.

7. The method of claim 1, wherein the command is selected from a preselected set of command types.

8. The method of claim 7, wherein the preselected set of command types is based on the type of downhole tool.

9. The method of claim 7, wherein the downhole tool is a directional drilling tool or rotary steerable system, and the preselected set of command types comprises modify offset, modify toolface, enter hold mode, modify target inclination, modify target azimuth, modify target dog-leg, modify surface-measured drilling speed, modify hold-mode gain change, enter uplink telemetry mode, enter pad/blade extend mode, or enter pad/blade retract mode.

10. The method of claim 7, wherein the first code of the message identifies a command type for the message of the preselected set of command types.

11. The method of claim 1, wherein generating the message comprises parsing the command based on a predetermined command syntax.

12. The method of claim 11, wherein the first code value of the first code of the message determines a type of the command.

13. The method of claim 12, wherein the second code value of the second code of the message determines a meaning of at least one other code of the message.

14. The method of claim 13 wherein the code value of the first code, the second code, or the first and second code determine a message syntax.

15. The method of claim 12, wherein the value of one or more codes of the message determine a content of the command.

16. The method of claim 1, wherein the set point RPM is selected based on one or more operating conditions of the drilling system.

17. The method of claim 16, wherein the set point RPM is selected to avoid one or more of torsional vibration, stick slip, and whirl.

18. The method of claim 1, wherein each code of the message includes a code value, each code value of each code corresponding to an RPM value or a duration of a drill string rotation step, the RPM value being an RPM offset from the set point RPM.

19. The method of claim 18, wherein encoding the message includes determining the RPM value or duration based on the drill string rotation step and set point RPM.

20. The method of claim 18, wherein the first code of the message is encoded onto an RPM value of a first drill string rotation step, and the second code of the message is encoded to a duration of the first drill string rotation step.

21. The method of claim 1, wherein the drill string is rotated at the set point RPM for a first predetermined duration of time corresponding to a first drill string rotation step.

22. The method of claim 21, wherein the drill string is rotated consistent with the first code of the encoded message during a second drill string rotation step for a second duration of time.

23. The method of claim 22, wherein the second duration is determined by the value of the second code.

24. The method of claim 22, wherein the second duration is a second preselected duration of time.

25. The method of claim 1, wherein the rotation rate of the drill string is generally constant where the rotation rate remains within an RPM window.

26. The method of claim 1, further comprising establishing an RPM window for each possible code to be received for a first drill string rotation step subsequent to the set point RPM, the RPM windows determined based on the set point RPM.

27. The method of claim 26, wherein determining that the first code has been received by the downhole decoder comprises determining if the rotation rate of the drill string is generally constant within an established RPM window.

28. The method of claim 27, wherein determining that the second code has been received by the downhole decoder comprises measuring the duration of the drill string rotation step and decoding a code value corresponding to the second code.

29. The method of claim 28, wherein decoding the second code comprises determining the code value associated with the duration of the drill string rotation step.

30. The method of claim 26, wherein decoding the first code comprises identifying the code value associated with the RPM window.

31. The method of claim 1, further comprising:

rotating the drill string consistent with a third code of the encoded message;

decoding the third code; and wherein the command is identified from the decoded first, second, and third codes.

32. The method of claim 31, further comprising establishing an RPM window for each possible code value for the third code to be received for a second drill string rotation step subsequent to the first drill string rotation step, the RPM windows determined based on the set point RPM.

33. The method of claim 32, wherein determining that the third code has been received by the downhole decoder comprises determining if the rotation rate of the drill string is generally constant within an established RPM window during the second drill string rotation step.

34. The method of claim 1, further comprising filtering the rotation rate of the drill string, the filtering including non-linear filtering and/or linear filtering.

35. The method of claim 1, wherein the downhole tool is a directional drilling tool.

36. The method of claim 35, wherein the downhole tool is a rotary steerable system, a turbine assisted rotary steerable system, a gear-reduced turbine assisted rotary steerable system, a rotary steerable motor, a steerable coiled tubing tool, a steerable motor, or a steerable turbine.

* * * * *